US008899767B2

(12) United States Patent
Harbers et al.

(10) Patent No.: US 8,899,767 B2
(45) Date of Patent: Dec. 2, 2014

(54) GRID STRUCTURE ON A TRANSMISSIVE LAYER OF AN LED-BASED ILLUMINATION MODULE

(75) Inventors: Gerard Harbers, Sunnyvale, CA (US); Gregory W. Eng, Fremont, CA (US); Peter K. Tseng, San Jose, CA (US); John S. Yriberri, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 228 days.

(21) Appl. No.: 13/431,824

(22) Filed: Mar. 27, 2012

(65) Prior Publication Data

US 2012/0250304 A1 Oct. 4, 2012

Related U.S. Application Data

(60) Provisional application No. 61/470,389, filed on Mar. 31, 2011.

(51) Int. Cl.

| | |
|---|---|
| ***F21V 9/00*** | (2006.01) |
| ***F21V 29/00*** | (2006.01) |
| ***F21K 99/00*** | (2010.01) |
| ***F21V 7/00*** | (2006.01) |
| *F21Y 101/02* | (2006.01) |
| *F21Y 105/00* | (2006.01) |

(52) U.S. Cl.

CPC ..... *F21V 7/0008* (2013.01); *F21Y 2101/02* (2013.01); *F21V 29/2206* (2013.01); *F21K 9/56* (2013.01); *F21K 9/137* (2013.01); *F21V 29/225* (2013.01); *F21V 7/0025* (2013.01); *F21K 9/54* (2013.01); *F21V 7/0083* (2013.01); *F21Y 2105/001* (2013.01)

USPC ..... 362/84; 362/231

(58) Field of Classification Search

USPC ..... 362/84, 230, 231, 34, 311.02, 330, 800; 313/498–504

See application file for complete search history.

(56) References Cited

U.S. PATENT DOCUMENTS

| | | | |
|---|---|---|---|
| 5,959,316 | A | 9/1999 | Lowery |
| 6,351,069 | B1 | 2/2002 | Lowery et al. |
| 6,504,301 | B1 | 1/2003 | Lowery |
| 6,586,882 | B1 | 7/2003 | Harbers |
| 6,600,175 | B1 | 7/2003 | Baretz et al. |
| 6,680,569 | B2 | 1/2004 | Mueller-Mach et al. |

(Continued)

FOREIGN PATENT DOCUMENTS

| | | | |
|---|---|---|---|
| KR | 10-0924912 | B1 | 11/2009 |
| WO | WO 2005/104252 | A2 | 11/2005 |
| WO | WO 2010/067291 | A1 | 6/2010 |

OTHER PUBLICATIONS

English Abstract of KR 10-0924912 published on Nov. 3, 2009 visited at <http://worldwide.espacenet.com> on Sep. 19, 2012, 1 page.

(Continued)

*Primary Examiner* — Bao Q Truong

(74) *Attorney, Agent, or Firm* — Silicon Valley Patent Group LLP

(57) ABSTRACT

An illumination module includes a plurality of Light Emitting Diodes (LEDs). A grid structure is present on a transmissive layer over the LEDs, such as an output window, to form a plurality of color conversion pockets. A portion of the pockets are coated with a first type of wavelength converting material while other portions of the pockets are coated with a different type of wavelength converting material.

20 Claims, 16 Drawing Sheets

(56) References Cited

U.S. PATENT DOCUMENTS

| | | | | |
|---|---|---|---|---|
| 6,812,500 | B2 | 11/2004 | Reeh et al. | |
| 7,052,152 | B2 * | 5/2006 | Harbers et al. | 362/30 |
| 7,126,162 | B2 | 10/2006 | Reeh et al. | |
| 7,250,715 | B2 | 7/2007 | Mueller et al. | |
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 2007/0058357 | A1 | 3/2007 | Yamaguchi et al. | |
| 2007/0081336 | A1 | 4/2007 | Bierhuizen et al. | |
| 2009/0101930 | A1 * | 4/2009 | Li | 257/98 |
| 2009/0147513 | A1 | 6/2009 | Kolodin et al. | |
| 2010/0301360 | A1 | 12/2010 | van de Ven et al. | |
| 2010/0321919 | A1 | 12/2010 | Yang | |
| 2011/0170277 | A1 * | 7/2011 | Li | 362/84 |

OTHER PUBLICATIONS

International Search Report and Written Opinion mailed on Aug. 20, 2012 for PCT Application No. PCT/US2012/031215 filed on Mar. 29, 2012, 25 pages.

Invitation to Pay Additional Fees mailed on Jul. 5, 2012 for PCT Application No. PCT/US2012/031215 filed on Mar. 29, 2012, 8 pages.

* cited by examiner

GRID STRUCTURE ON A TRANSMISSIVE LAYER OF AN LED-BASED ILLUMINATION MODULE

CROSS REFERENCE TO RELATED APPLICATIONS

This application claims priority under 35 USC 119 to U.S. Provisional Application No. 61/470,389, filed Mar. 31, 2011, which is incorporated by reference herein in its entirety.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application.

Consequently, improvements to illumination device that uses light emitting diodes as the light source are desired.

SUMMARY

An illumination module includes a plurality of Light Emitting Diodes (LEDs). A grid structure is present on a transmissive layer over the LEDs, such as an output window, to form a plurality of color conversion pockets. A portion of the pockets are coated with a first type of wavelength converting material while other portions of the pockets are coated with a different type of wavelength converting material.

Further details and embodiments and techniques are described in the detailed description below. This summary does not define the invention. The invention is defined by the claims.

DETAILED DESCRIPTION

Reference will now be made in detail to background examples and some embodiments of the invention, examples of which are illustrated in the accompanying drawings.

Figure 1:
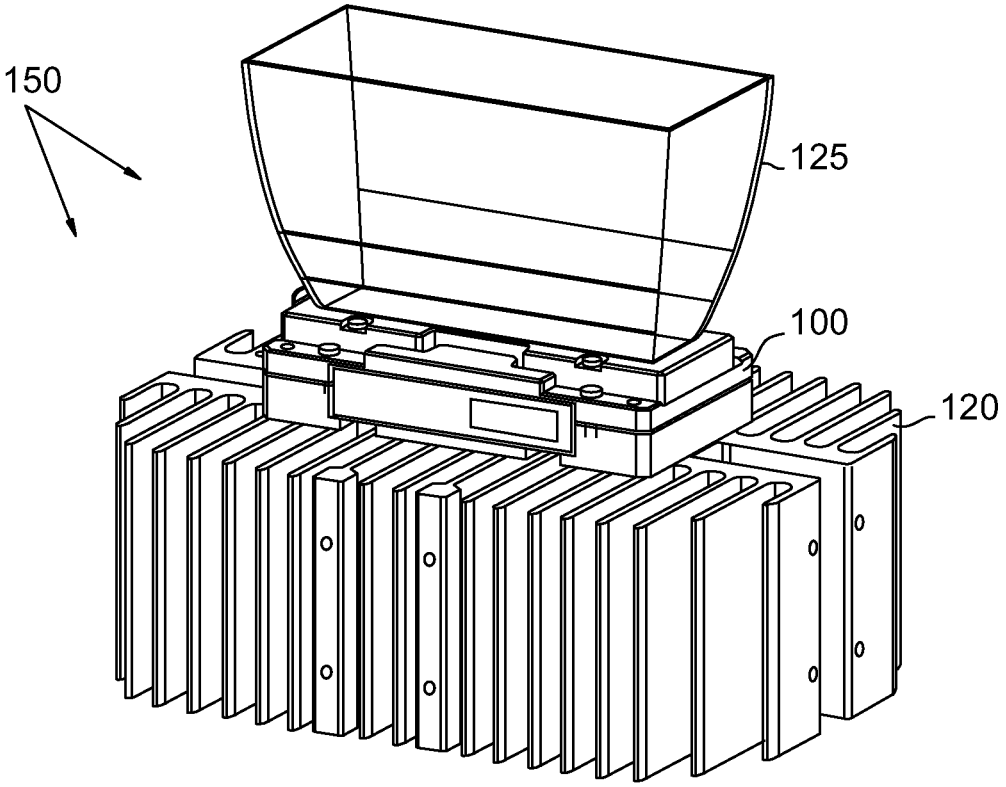
FIGS. 1, 2, and 3 illustrate three exemplary luminaires, including an illumination device, reflector, and light fixture.
Figure 2:
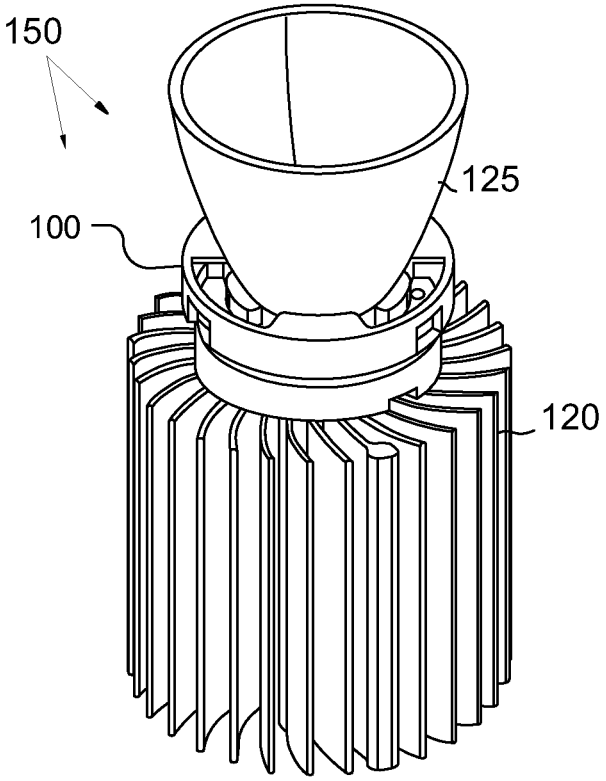
Figure 3:
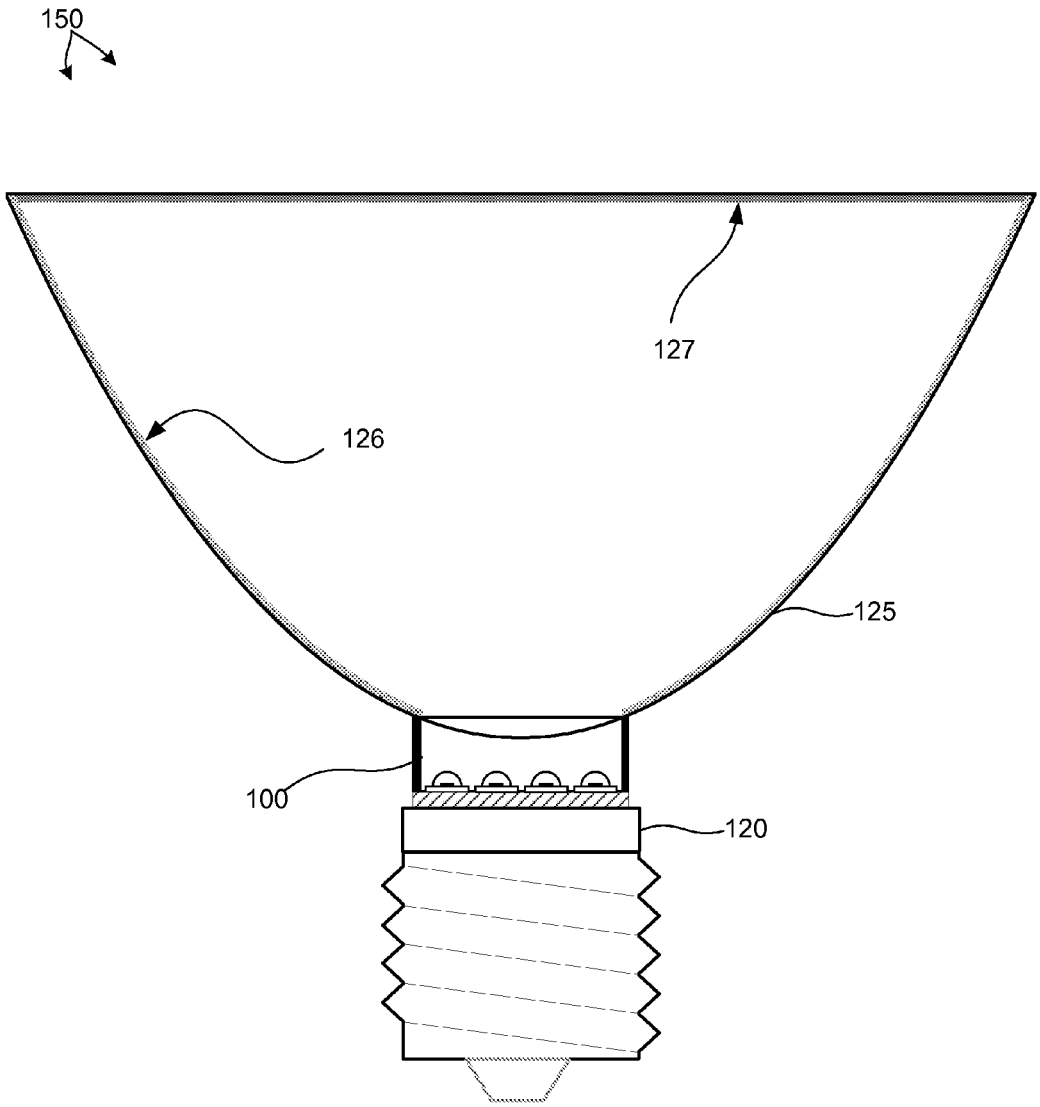

FIGS. 1, 2, and 3 illustrate three exemplary luminaires, all labeled 150. The luminaire illustrated in FIG. 1 includes an illumination module 100 with a rectangular form factor. The luminaire illustrated in FIG. 2 includes an illumination module 100 with a circular form factor. The luminaire illustrated in FIG. 3 includes an illumination module 100 integrated into a retrofit lamp device. These examples are for illustrative purposes. Examples of illumination modules of general polygonal and elliptical shapes may also be contemplated. Luminaire 150 includes illumination module 100, reflector 125, and light fixture 120. As depicted, light fixture 120 includes a heat sink capability, and therefore may be sometimes referred to as heat sink 120. However, light fixture 120 may include other structural and decorative elements (not shown). Reflector 125 is mounted to illumination module 100 to collimate or deflect light emitted from illumination module 100. The reflector 125 may be made from a thermally conductive material, such as a material that includes aluminum or copper and may be thermally coupled to illumination module 100. Heat flows by conduction through illumination module 100 and the thermally conductive reflector 125. Heat also flows via thermal convection over the reflector 125. Reflector 125 may be a compound parabolic concentrator, where the concentrator is constructed of or coated with a highly reflecting material. Optical elements, such as a diffuser or reflector 125 may be removably coupled to illumination module 100, e.g., by means of threads, a clamp, a twist-lock mechanism, or other appropriate arrangement. As illustrated in FIG. 3, the reflector 125 may include sidewalls 126 and a window 127 that are optionally coated, e.g., with a wavelength converting material, diffusing material or any other desired material.

As depicted in FIGS. 1, 2, and 3, illumination module 100 is mounted to heat sink 120. Heat sink 120 may be made from a thermally conductive material, such as a material that includes aluminum or copper and may be thermally coupled to illumination module 100. Heat flows by conduction through illumination module 100 and the thermally conductive heat sink 120. Heat also flows via thermal convection over heat sink 120. Illumination module 100 may be attached to heat sink 120 by way of screw threads to clamp the illumination module 100 to the heat sink 120. To facilitate easy removal and replacement of illumination module 100, illumination module 100 may be removably coupled to heat sink 120, e.g., by means of a clamp mechanism, a twist-lock mechanism, or other appropriate arrangement. Illumination module 100 includes at least one thermally conductive surface that is thermally coupled to heat sink 120, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 120 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 4:
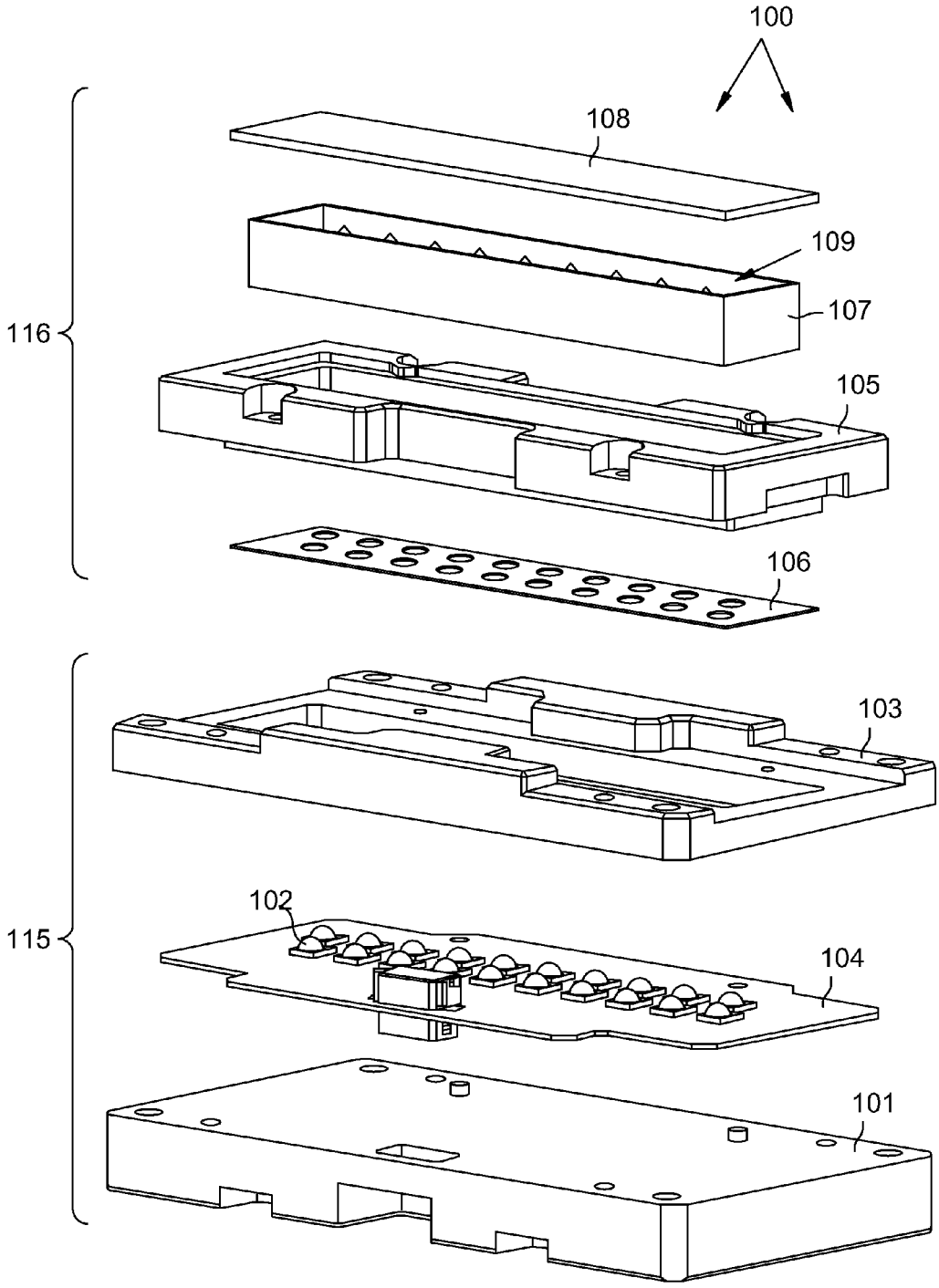
FIG. 4 shows an exploded view illustrating components of LED based illumination device as depicted in FIG. 1.

FIG. 4 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. For example, an LED based illumination module may be an LED based replacement lamp such as depicted in FIG. 3. LED based illumination module 100 includes one or more LED die or packaged LEDs and a mounting board to which LED die or packaged LEDs are attached. In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. Light conversion sub-assembly 116 optionally includes either or both bottom reflector insert 106 and sidewall insert 107. Output window 108, if used as the output port, is fixed to the top of cavity body 105. In some embodiments, output window 108 may be fixed to cavity body 105 by an adhesive. To promote heat dissipation from the output window to cavity body 105, a thermally conductive adhesive is desirable. The adhesive should reliably withstand the temperature present at the interface of the output window 108 and cavity body 105. Furthermore, it is preferable that the adhesive either reflect or transmit as much incident light as possible, rather than absorbing light emitted from output window 108. In one example, the combination of heat tolerance, thermal conductivity, and optical properties of one of several adhesives manufactured by Dow Corning (USA) (e.g., Dow Corning model number SE4420, SE4422, SE4486, 1-4173, or SE9210), provides suitable performance. However, other thermally conductive adhesives may also be considered.

Either the interior sidewalls of cavity body 105 or sidewall insert 107, when optionally placed inside cavity body 105, is reflective so that light from LEDs 102, as well as any wavelength converted light, is reflected within the cavity 160 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper or curve outward from mounting board 104 to output window 108, rather than perpendicular to output window 108 as depicted.

Bottom reflector insert 106 and sidewall insert 107 may be highly reflective so that light reflecting downward in the cavity 160 is reflected back generally towards the output port, e.g., output window 108. Additionally, inserts 106 and 107 may have a high thermal conductivity, such that it acts as an additional heat spreader. By way of example, the inserts 106 and 107 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of inserts 106 and 107 with one or more reflective coatings. Inserts 106 and 107 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, inserts 106 and 107 may be made from a polytetrafluoroethylene (PTFE) material. In some examples inserts 106 and 107 may be made from a PTFE material of one to two millimeters thick, as sold by W.L. Gore (USA) and Berghof (Germany). In yet other embodiments, inserts 106 and 107 may be constructed from a PTFE material backed by a thin reflective layer such as a metallic layer or a non-metallic layer such as ESR, E60L, or MCPET. Also, highly diffuse reflective coatings can be applied to any of sidewall insert 107, bottom reflector insert 106, output window 108, cavity body 105, and mounting board 104. Such coatings may include titanium dioxide (TiO2), zinc oxide (ZnO), and barium sulfate (BaSO4) particles, or a combination of these materials.

Figure 5A:
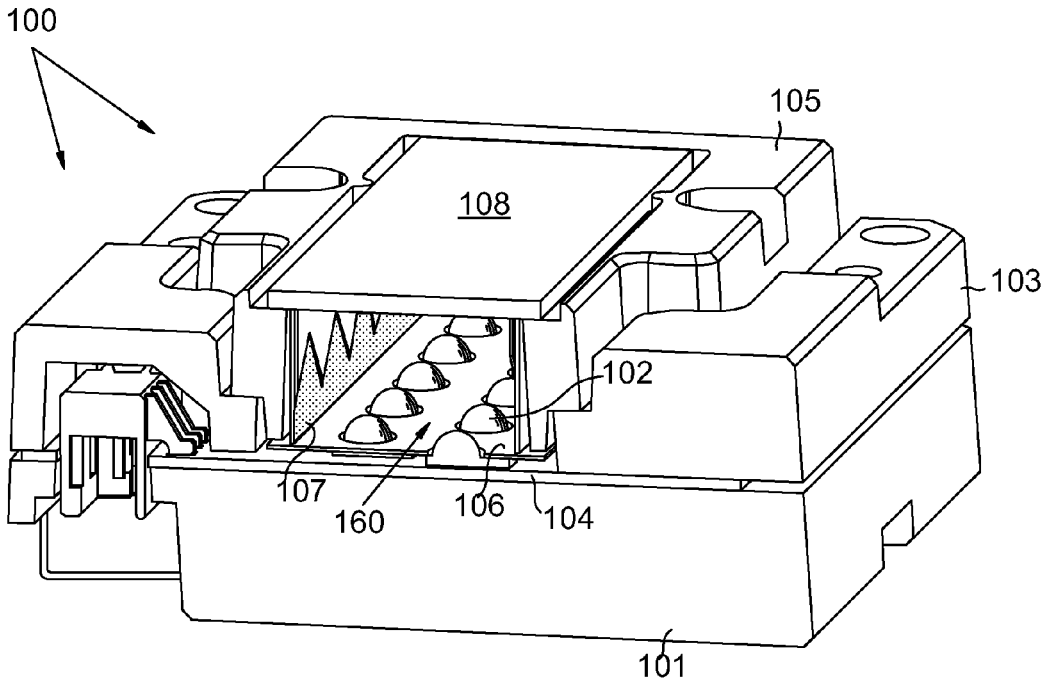
FIGS. 5A and 5B illustrates a perspective, cross-sectional view of LED based illumination device as depicted in FIG. 1.
Figure 5B:
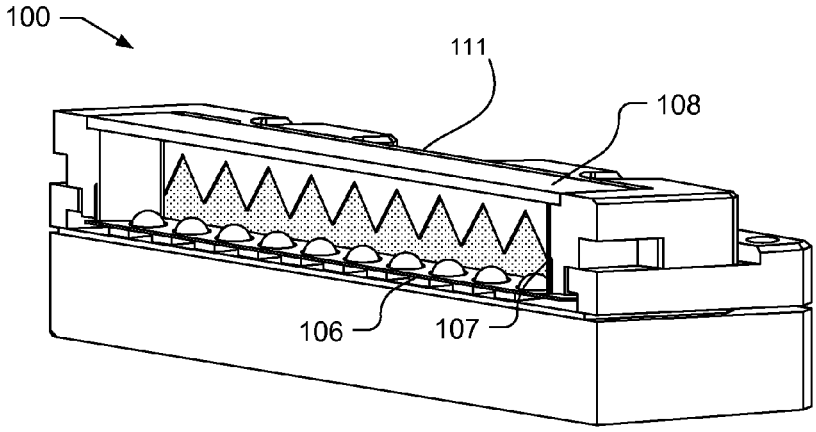

FIGS. 5A and 5B illustrate perspective, cross-sectional views of LED based illumination module 100 as depicted in FIG. 1. In this embodiment, the sidewall insert 107, output window 108, and bottom reflector insert 106 disposed on mounting board 104 define a light mixing cavity 160 (illustrated in FIG. 5A) in the LED based illumination module 100. A portion of light from the LEDs 102 is reflected within light mixing cavity 160 until it exits through output window 108. Reflecting the light within the cavity 160 prior to exiting the output window 108 has the effect of mixing the light and providing a more uniform distribution of the light that is emitted from the LED based illumination module 100. In addition, as light reflects within the cavity 160 prior to exiting the output window 108, an amount of light is color converted by interaction with a wavelength converting material included in the cavity 160.

Although as depicted in FIGS. 1-5B, LED based illumination module 100 includes a single color conversion cavity 160, other embodiments are introduced herein. In one aspect, output window 108 may be a three-dimensionally shaped shell structure to promote light extraction, color conversion, and shaping of the output beam profile. In another aspect, a grid structure forming a plurality of pockets may be attached to a window of the LED based illumination module 100. By coating different pockets with different wavelength converting materials, the color point of light emitted from illumination module 100 can be tuned and output beam uniformity improved. In yet another aspect, an LED based illumination module 100 may include a number of color conversion cavities 160, each cavity surrounding a different LED or group of LEDs. By varying the color conversion properties of different color conversion cavities 160, the color point of light emitted from illumination module 100 can be tuned and output beam uniformity improved. In addition, a secondary mixing cavity may be positioned to collect the light emitted from each color conversion cavity and further mix the light before exiting illumination module 100. In yet another aspect, a color conversion cavity may be configured to disperse and color convert light emitted from an LED 102 over a broad area by transmitting light laterally and away from an LED by a series of reflections within the color conversion cavity. In some examples, light emitted from the LED may be color converted by a wavelength converting material embedded within the color conversion cavity. In some examples, light emitted from the LED may be color converted by a wavelength converting material located at the output of the color conversion cavity.

LEDs 102 can emit different or the same colors, either by direct emission or by phosphor conversion, e.g., where phosphor layers are applied to the LEDs as part of the LED package. The illumination device 100 may use any combination of colored LEDs 102, such as red, green, blue, amber, or cyan, or the LEDs 102 may all produce the same color light. Some or all of the LEDs 102 may produce white light. In addition, the LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. The light emitted from the illumination device 100 has a desired color when LEDs 102 are used in combination with wavelength converting materials included in color conversion cavity 160. The photo converting properties of the wavelength converting materials in combination with the mixing of light within cavity 160 results in a color converted light output. By tuning the chemical and/or physical (such as thickness and concentration) properties of the wavelength converting materials and the geometric properties of the coatings on the interior surfaces of cavity 160, specific color properties of light output by output window 108 may be specified, e.g., color point, color temperature, and color rendering index (CRI).

For purposes of this patent document, a wavelength converting material is any single chemical compound or mixture of different chemical compounds that performs a color conversion function, e.g. absorbs an amount of light of one peak wavelength, and in response, emits an amount of light at another peak wavelength.

Portions of cavity 160, such as the bottom reflector insert 106, sidewall insert 107, cavity body 105, output window 108, and other components placed inside the cavity (not shown) may be coated with or include a wavelength converting material. FIG. 5B illustrates portions of the sidewall insert 107 coated with a wavelength converting material. Furthermore, different components of cavity 160 may be coated with the same or a different wavelength converting material.

By way of example, phosphors may be chosen from the set denoted by the following chemical formulas: $Y_3Al_5O_{12}$:Ce, (also known as YAG:Ce, or simply YAG) $(Y,Gd)_3Al_5O_{12}$:Ce, CaS:Eu, SrS:Eu, $SrGa_2S_4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca) $AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3$ Cl:Eu, $Cs_2CaP_2O_7$, $Cs_2SrP_2O_7$, $Lu_3Al_5O_{12}$:Ce, $Ca_8Mg$ $(SiO_4)_4Cl_2$:Eu, $Sr_8Mg(SiO_4)_4Cl_2$:Eu, $La_3Si_6N_{11}$:Ce, $Y_3Ga_5O_{12}$:Ce, $Gd_3Ga_5O_{12}$:Ce, $Tb_3Al_5O_{12}$:Ce, $Tb_3Ga_5O_{12}$: Ce, and $Lu_3Ga_5O_{12}$:Ce.

In one example, the adjustment of color point of the illumination device may be accomplished by replacing sidewall insert 107 and/or the output window 108, which similarly may be coated or impregnated with one or more wavelength converting materials. In one embodiment a red emitting phosphor such as a europium activated alkaline earth silicon nitride (e.g., (Sr,Ca)$AlSiN_3$:Eu) covers a portion of sidewall insert 107 and bottom reflector insert 106 at the bottom of the cavity 160, and a YAG phosphor covers a portion of the output window 108. In another embodiment, a red emitting phosphor such as alkaline earth oxy silicon nitride covers a portion of sidewall insert 107 and bottom reflector insert 106 at the bottom of the cavity 160, and a blend of a red emitting alkaline earth oxy silicon nitride and a yellow emitting YAG phosphor covers a portion of the output window 108.

In some embodiments, the phosphors are mixed in a suitable solvent medium with a binder and, optionally, a surfactant and a plasticizer. The resulting mixture is deposited by any of spraying, screen printing, blade coating, or other suitable means. By choosing the shape and height of the sidewalls that define the cavity, and selecting which of the parts in the cavity will be covered with phosphor or not, and by optimization of the layer thickness and concentration of the phosphor layer on the surfaces of light mixing cavity 160, the color point of the light emitted from the module can be tuned as desired.

In one example, a single type of wavelength converting material may be patterned on the sidewall, which may be, e.g., the sidewall insert 107 shown in FIG. 5B. By way of example, a red phosphor may be patterned on different areas of the sidewall insert 107 and a yellow phosphor may cover the output window 108. The coverage and/or concentrations of the phosphors may be varied to produce different color temperatures. It should be understood that the coverage area of the red and/or the concentrations of the red and yellow phosphors will need to vary to produce the desired color temperatures if the light produced by the LEDs 102 varies. The color performance of the LEDs 102, red phosphor on the sidewall insert 107 and the yellow phosphor on the output window 108 may be measured before assembly and selected based on performance so that the assembled pieces produce the desired color temperature.

In many applications it is desirable to generate white light output with a correlated color temperature (CCT) less than 3,100 degrees Kelvin. For example, in many applications, white light with a CCT of 2,700 degrees Kelvin is desired. Some amount of red emission is generally required to convert light generated from LEDs emitting in the blue or UV portions of the spectrum to a white light output with a CCT less than 3,100 degrees Kelvin. Efforts are being made to blend yellow phosphor with red emitting phosphors such as CaS:Eu, SrS:Eu, $SrGa_2S_4$:Eu, $Ba_3Si_6O_{12}N_2$:Eu, (Sr,Ca)$AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSi_2O_2N_2$:Eu, $SrSi_2O_2N_2$:Eu, $BaSi_2O_2N_2$:Eu, $Sr_8Mg(SiO_4)_4Cl_2$:Eu, $Li_2NbF_7:Mn^{4+}$, $Li_3ScF_6:Mn^{4+}$, $La_2O_2S:Eu^{3+}$ and $MgO.MgF_2.GeO_2:Mn^{4+}$ to reach the required CCT. However, color consistency of the output light is typically poor due to the sensitivity of the CCT of the output light to the red phosphor component in the blend. Poor color distribution is more noticeable in the case of blended phosphors, particularly in lighting applications. By coating output window 108 with a phosphor or phosphor blend that does not include any red emitting phosphor, problems with color consistency may be avoided. To generate white light output with a CCT less than 3,100 degrees Kelvin, a red emitting phosphor or phosphor blend is deposited on any of the sidewalls and bottom reflector of LED based illumination module 100. The specific red emitting phosphor or phosphor blend (e.g., peak wavelength emission from 600 nanometers to 700 nanometers) as well as the concentration of the red emitting phosphor or phosphor blend are selected to generate a white light output with a CCT less than 3,100 degrees Kelvin. In this manner, an LED based illumination module may generate white light with a CCT less than 3,100K with an output window that does not include a red emitting phosphor component.

It is desirable for an LED based illumination module to convert a portion of light emitted from the LEDs (e.g. blue light emitted from LEDs 102) to longer wavelength light in at least one light mixing cavity 160 while minimizing photon loses. Densely packed, thin layers of phosphor are suitable to efficiently color convert a significant portion of incident light while minimizing loses associated with reabsorption by adjacent phosphor particles, total internal reflection (TIR), and Fresnel effects.

Figure 6:
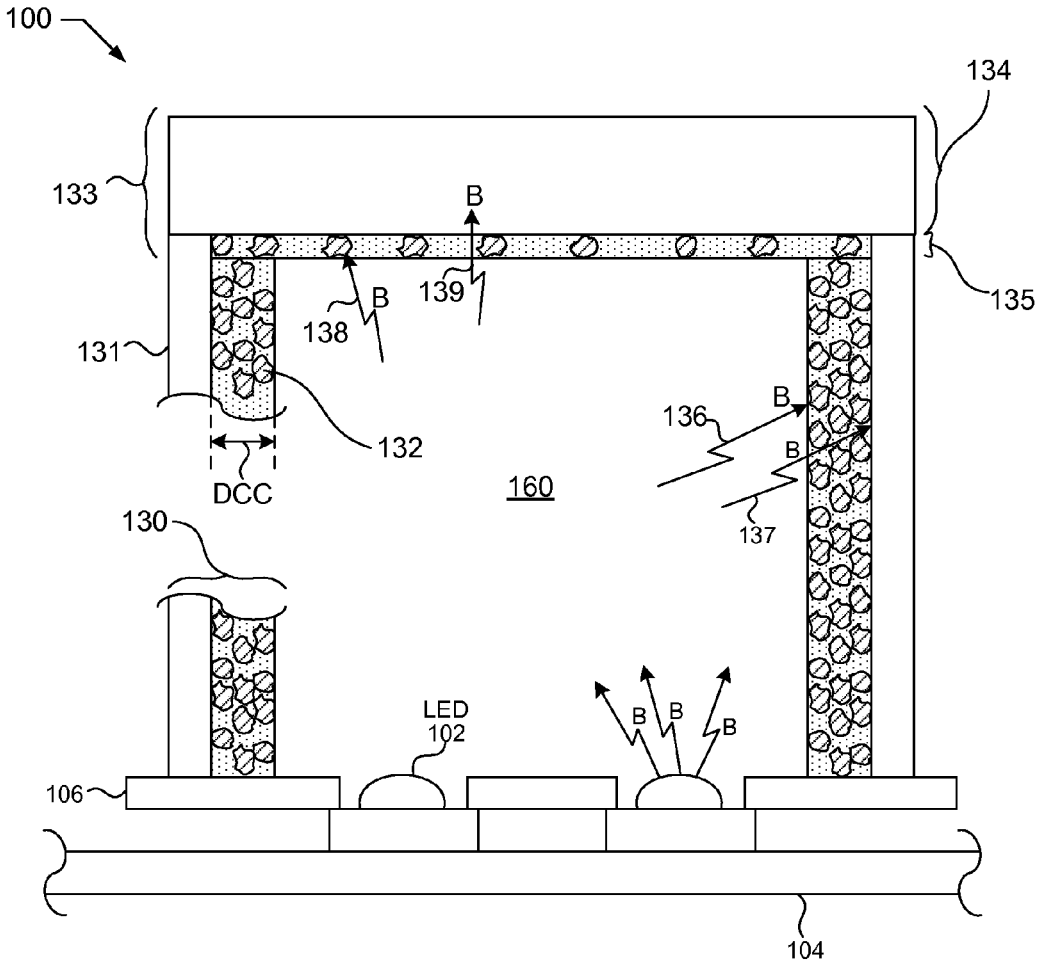
FIG. 6 is illustrative of a cross-sectional view of LED based illumination module that includes reflective and transmissive color converting elements coated with a layer of phosphor.

FIG. 6 is illustrative of a cross-sectional view of a color conversion cavity 160 focusing on the interaction of light emitted from an LED 102 with the components of cavity 160. As depicted, color conversion cavity 160 includes a reflective color converting element 130 and a transmissive color converting element 133. Transmissive color converting element 133 includes a color converting layer 135 fixed to an optically transmissive layer 134. Reflective color converting element 130 includes a color converting layer 132 fixed to a reflective layer 131.

Transmissive color converting element 133 provides highly efficient color conversion in a transmissive mode. Color converting layer 135 includes a sparse, thin layer of phosphor. Transmission of unconverted light is not desirable in lighting devices pumped with UV or sub-UV radiation because of the health risk to humans exposed to radiation at these wavelengths. However, for an LED based illumination module pumped by LEDs with emission wavelengths above UV, it is desirable for a significant percentage of unconverted light (e.g. blue light emitted from LEDs 102) to pass through light mixing cavity 160 without color conversion. This promotes high efficiency because losses inherent to the color conversion process are avoided. Sparsely packed, thin layers of phosphor are suitable to color convert a portion of incident light. For example, it is desirable to allow at least ten percent of incident light to be transmitted through the layer without conversion.

Reflective color converting element 130 provides highly efficient color conversion in a reflective mode. Color converting layer 132 is deposited on reflective layer 131 with a desired thickness at high density. In some embodiments, a thickness that is two times the average diameter of the phosphor particles with a packing density greater than 90% is desirable. In these embodiments, the average phosphor particle diameter is between six and eight microns.

Figure 7:
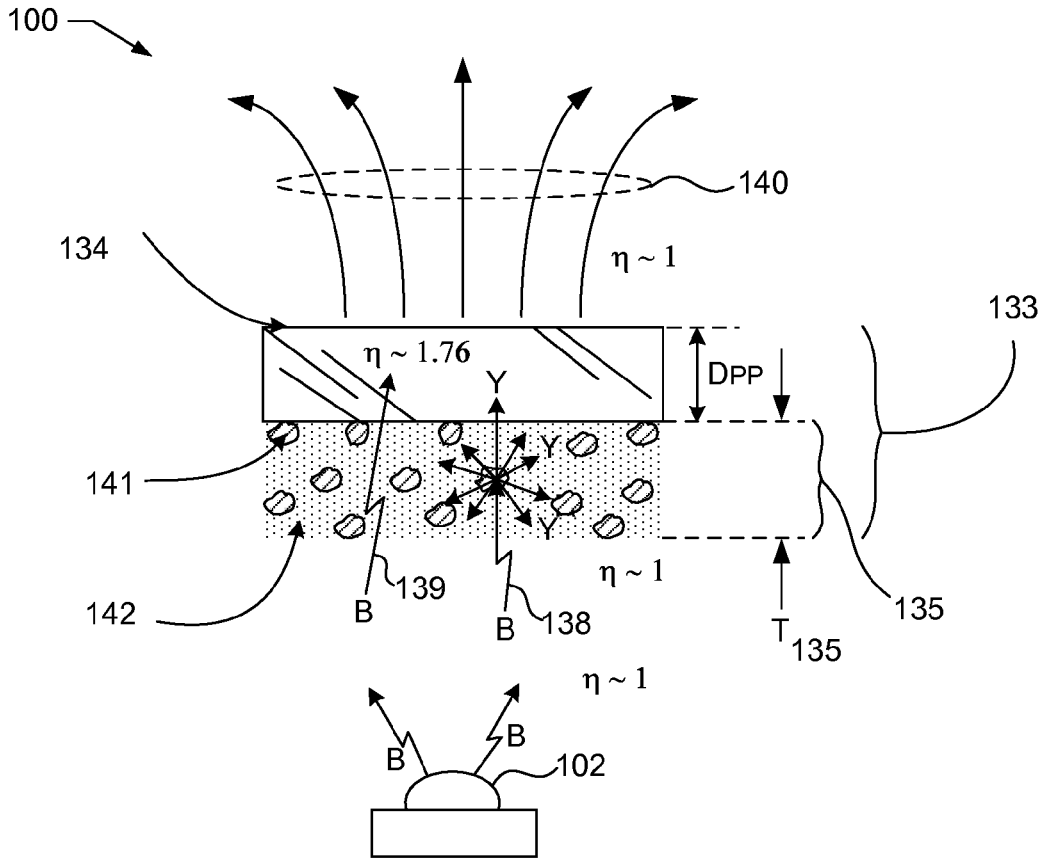
FIG. 7 illustrates a cross-sectional view of a portion of LED illumination module with the transmissive color converting element having a color converting layer with phosphor particles.

FIG. 7 illustrates a cross-sectional view of LED illumination module 100 focusing on the interaction of photons emitted by an LED 102 with transmissive color converting element 133. Transmissive layer 134 may be constructed from an optically clear medium (e.g. glass, sapphire, polycarbonate, plastic). Transmissive layer 134 may also be constructed from a translucent material (e.g., a thin layer of PTFE or an optically clear medium that has been etched). Transmissive color converting element 133 may include additional layers (not shown) to enhance optical system performance. In one example, transmissive color converting element 133 may include optical films such as a dichromic filter, a low index coating, additional layers such as a layer of scattering particles, or additional color converting layers including phosphor particles. In some embodiments, semi-transparent, color converting layer 135 includes phosphor particles 141 embedded in a polymer binder 142. Phosphor particles 141 are arranged to enable a portion of light to be transmitted through transmissive color converting element 133 without color conversion.

In one embodiment, semi-transparent color converting layer 135, deposited on optically transmissive layer 134, has a thickness $T_{135}$ that is three times the average diameter of the phosphor particles with a packing density greater than 80%. In this embodiment, the average phosphor particle diameter is ten microns.

As depicted in FIG. 7, blue photon 139 emitted from LED 102 passes through transmissive color converting element 133 without color conversion and contributes to combined light 140 as a blue photon. However, blue photon 138 emitted from LED 102 is absorbed by a phosphor particle embedded in color converting layer 135. In response to the stimulus provided by blue photon 138, the phosphor particle emits a light of a longer wavelength in an isotropic emission pattern. In the illustrated example, the phosphor particle emits yellow light. As illustrated in FIG. 7, a portion of the yellow emission passes through transmissive color converting element 133 and contributes to combined light 140 as a yellow photon. Another portion of the yellow emission is absorbed by adjacent phosphor particles and is either reemitted or lost. Yet another portion of the yellow emission is scattered back into light mixing cavity 160 where it is either reflected back toward transmissive color converting element 133 or is absorbed and lost within light mixing cavity 160.

Figure 8:
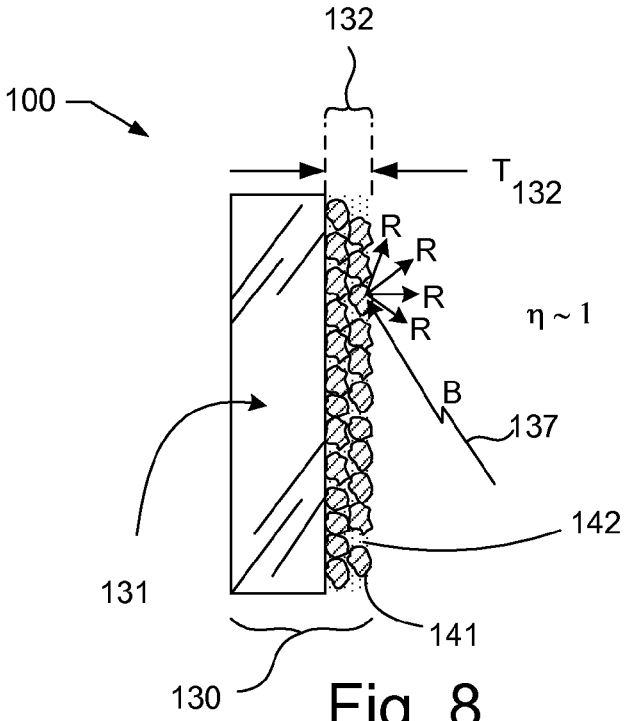
FIG. 8 illustrates a cross-sectional view of a portion of the LED illumination module with the reflective color converting element having phosphor particles.

FIG. 8 illustrates a cross-sectional view of a color conversion cavity 160 focusing on the interaction of photons emitted by an LED 102 with reflective color converting element 130. In some embodiments, color converting layer 132 has a thickness $T_{132}$ less than five times the average diameter of phosphor particles 141. The average diameter of phosphor particles 141 may be between one micrometer and twenty five micrometers. In some embodiments, the average diameter of phosphor particles 141 is between five and ten micrometers. Phosphor particles 141 are arranged with a packing density of more than eighty percent to increase the probability that an incoming photon of light will interact with a phosphor particle to generate converted light. For example, blue photon 137 emitted from LED 102 is incident to reflective color converting element 130 and is absorbed by a phosphor particle of color converting layer 132. In response to the stimulus provided by blue photon 137, the phosphor particle emits a light of a longer wavelength in an isotropic emission pattern. In the illustrated example, the phosphor particle emits red light. As illustrated in FIG. 8, a portion of the red emission enters light mixing cavity 160. Another portion of the red emission is absorbed by adjacent phosphor particles and is either reemitted or lost. Yet another portion of the red emission is reflected off of reflective layer 131 and is either transmitted through color converting layer 132 to light mixing cavity 160 or is absorbed by an adjacent phosphor particle and is either reemitted or lost.

Figure 9:
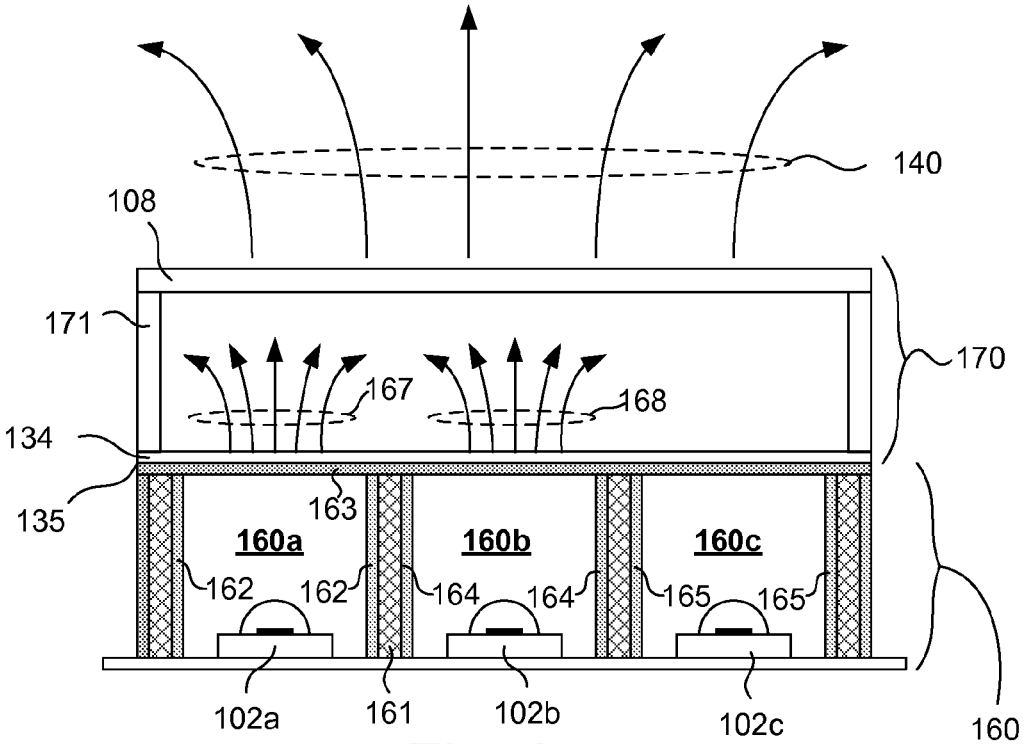
FIGS. 9-13 depict cross-sectional, side views of various embodiments of an LED based illumination module 100 that includes a number of color conversion cavities.

FIGS. 9-13 depict cross-sectional, side views of various embodiments of LED based illumination module 100. FIG. 9 illustrates one aspect of an LED based illumination module 100 that includes a number of color conversion cavities 160. Each color conversion cavity (e.g., 160*a*, 160*b*, and 160*c*) is configured to color convert light emitted from each LED (e.g., 102*a*, 102*b*, 102*c*), respectively, before the light from each color conversion cavity is combined. By altering any of the chemical composition of one or more of the color conversion cavities, the geometric properties of the wavelength converting coatings in one or more of the color conversion cavities, the current supplied to any LED emitting into any of the color conversion cavities, and the shape of one or more of the color conversion cavities the color of light emitted from LED based illumination module 100 may be controlled and output beam uniformity improved.

As depicted in FIG. 9, LED 102*a* emits light directly into color conversion cavity 160*a* only. Similarly, LED 102*b* emits light directly into color conversion cavity 160*b* only and LED 102*c* emits light directly into color conversion cavity 160*c* only. Each LED is isolated from the others by a reflective sidewall. For example, as depicted, reflective sidewall 161 separates LED 102*a* from 102*b*.

Reflective sidewall 161 is highly reflective so that, for example, light emitted from a LED 102*b* is directed upward in color conversion cavity 160*b* generally towards the output window 108 of illumination module 100. Additionally, reflective sidewall 161 may have a high thermal conductivity, such that it acts as an additional heat spreader. By way of example, the reflective sidewall 161 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of reflective sidewall 161 with one or more reflective coatings. Reflective sidewall 161 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, reflective sidewall 161 may be made from a PTFE material. In some examples reflective sidewall 161 may be made from a PTFE material of one to two millimeters thick, as sold by W.L. Gore (USA) and Berghof (Germany). In yet other embodiments, reflective sidewall 161 may be constructed from a PTFE material backed by a thin reflective layer such as a metallic layer or a non-metallic layer such as ESR, E60L, or MCPET. Also, highly diffuse reflective coatings can be applied to reflective sidewall 161. Such coatings may include titanium dioxide (TiO2), zinc oxide (ZnO), and barium sulfate (BaSO4) particles, or a combination of these materials.

In one aspect LED based illumination module 100 includes a first color conversion cavity (e.g., 160*a*) with an interior surface area coated with a first wavelength converting material 162 and a second color conversion cavity (e.g., 160*b*) with an interior surface area coated with a second wavelength converting material 164. In some embodiments, the LED based illumination module 100 includes a third color conversion cavity (e.g., 160*c*) with an interior surface area coated with a third wavelength converting material 165. In some other embodiments, the LED based illumination module 100 may include additional color conversion cavities including additional, different wavelength converting materials. In some embodiments, a number of color conversion cavities include an interior surface area coated with the same wavelength converting material.

As depicted in FIG. 9, in one embodiment, LED based illumination module 100 also includes a transmissive layer 134 mounted above the color conversion cavities 160. In some embodiments, transmissive layer 134 is coated with a color converting layer 135 that includes a wavelength converting material 163. In one example, wavelength converting materials 162, 164, and 165 may include red emitting phosphor materials and wavelength converting material 163 includes yellow emitting phosphor materials. Transmissive layer 134 promotes mixing of light output by each of the color conversion cavities.

In some examples, each wavelength conversion material included in color conversion cavities 160 and color converting layer 135 is selected such that a color point of combined light 140 emitted from LED based illumination module 100 matches a target color point.

In some embodiments, a secondary mixing cavity 170 is mounted above the color conversion cavities 160. Secondary mixing cavity 170 is a closed cavity that promotes the mixing of the light output by the color conversion cavities 160 such that combined light 140 emitted from LED based illumination module 100 is uniform in color. As depicted in FIG. 9, secondary mixing cavity 170 includes a reflective sidewall 171 mounted along the perimeter of color conversion cavities 160 to capture the light output by the color conversion cavities 160. Secondary mixing cavity 170 includes an output window 108 mounted above the reflective sidewall 171. Light emitted from the color conversion cavities 160 reflects off of the interior facing surfaces of the secondary color conversion cavity and exit the output window 108 as combined light 140.

Figure 10:
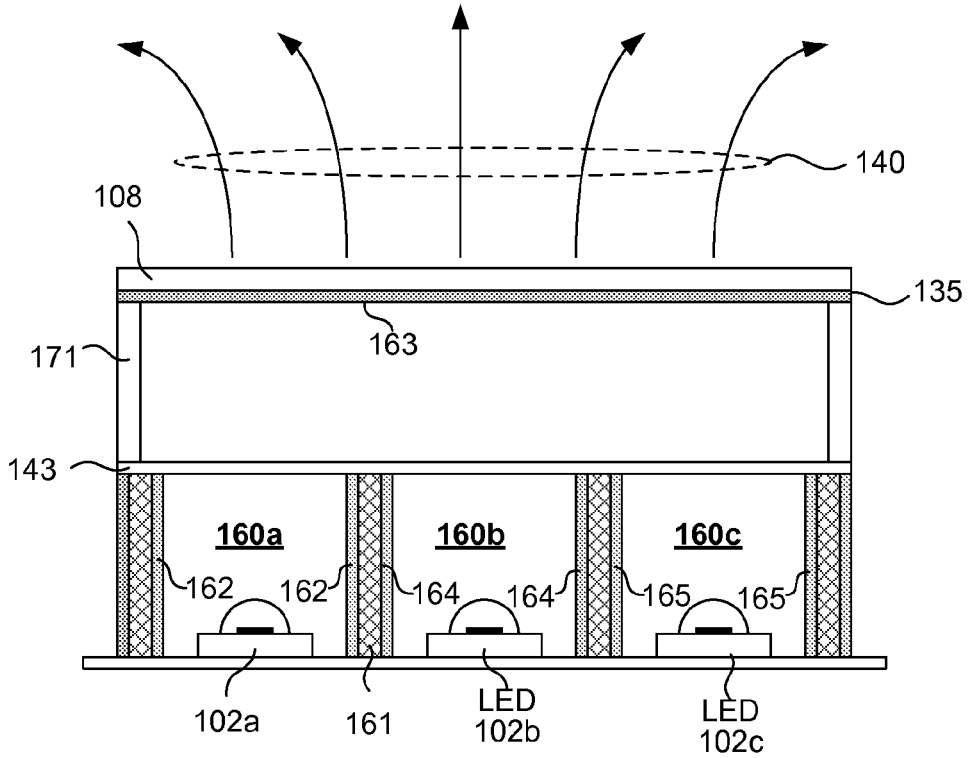

As depicted in FIG. 10, in one embodiment, LED based illumination module 100 includes color conversion cavities 160 and secondary mixing cavity 170. As depicted, output window 108 of secondary mixing cavity 170 is coated with color converting layer 135 that includes wavelength converting material 163. In one example, wavelength converting materials 162, 164, and 165 may include red emitting phosphor materials and wavelength converting material 163 includes yellow emitting phosphor materials. A diffuser layer 143 mounted above color conversion cavities 160 may be optionally included to promote mixing of light output by each of the color conversion cavities. In some embodiments, diffuser layer 143 does not perform a color conversion function.

Diffuser layer 143 may be constructed from a translucent material (e.g., a thin layer of PTFE) or an optically transparent medium (e.g. glass, sapphire, polycarbonate, plastic) that has been treated (e.g., etched) or coated with a material (e.g., $TiO_2$) to make it more optically diffuse.

Figure 11:
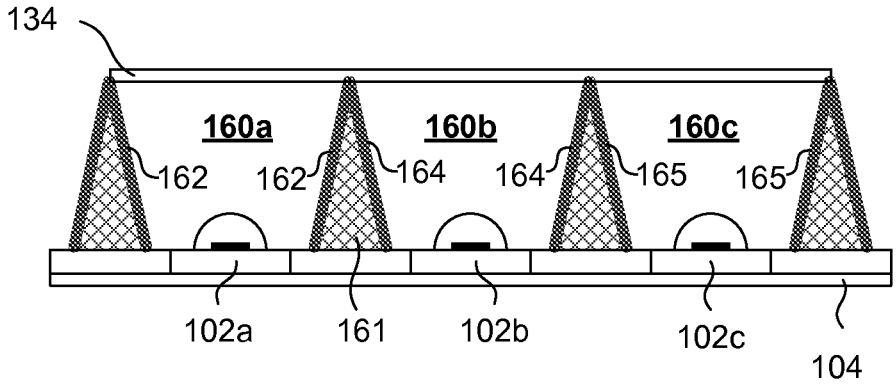

As depicted in FIGS. 9 and 10, LEDs 102 are mounted in a plane and reflective sidewall 161 includes flat surfaces oriented perpendicular to the plane upon which LEDs 102 are mounted. Flat, vertically oriented surfaces have been found to efficiently color convert light while minimizing back reflection. However, other surface shapes and orientations may be considered as well. For example, FIG. 11 depicts reflective sidewall 161 including flat surfaces oriented at an oblique angle with respect to the plane upon which LEDs 102 are mounted. In some examples, this configuration promotes light extraction from the color conversion cavities 160.

Figure 12:
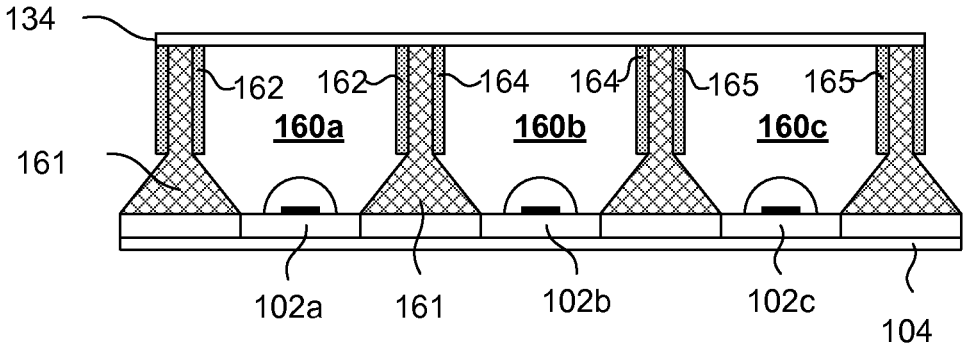

FIG. 12 depicts reflective sidewall 161 in another embodiment. As depicted, reflective sidewall 161 includes a tapered portion that includes a flat surface oriented at an oblique angle with respect to the plane upon which the LEDs 102 are mounted. The tapered portion transitions to a flat surface oriented perpendicular to the plane upon which the LEDs 102 are mounted. In other embodiments, the tapered portion includes a curved surface that transitions to the flat, vertically oriented surface. In some examples, these embodiments promote light extraction from the color conversion cavities 160 while efficiently color converting light emitted from the LEDs 102. Also, as depicted in FIG. 11, wavelength converting material (e.g., wavelength converting materials 162, 164, and 165) are disposed on the flat, vertically oriented surfaces of reflective sidewalls 161.

As discussed above, the color of light emitted from an LED based illumination module 100 that includes a number of color conversion cavities can be tuned to match a target color point by selecting each wavelength conversion material included in the color conversion cavities 160 and by selection of a wavelength converting material included in color converting layer 135. In other embodiments, the color of light emitted from the LED based illumination module 100 may be tuned by selecting LEDs 102 with a different peak emission wavelength. For example, LED 102*a* may be selected to have a peak emission wavelength of 480 nanometers, while LED 102*b* may be selected to have a peak emission wavelength of 460 nanometers.

Figure 13:
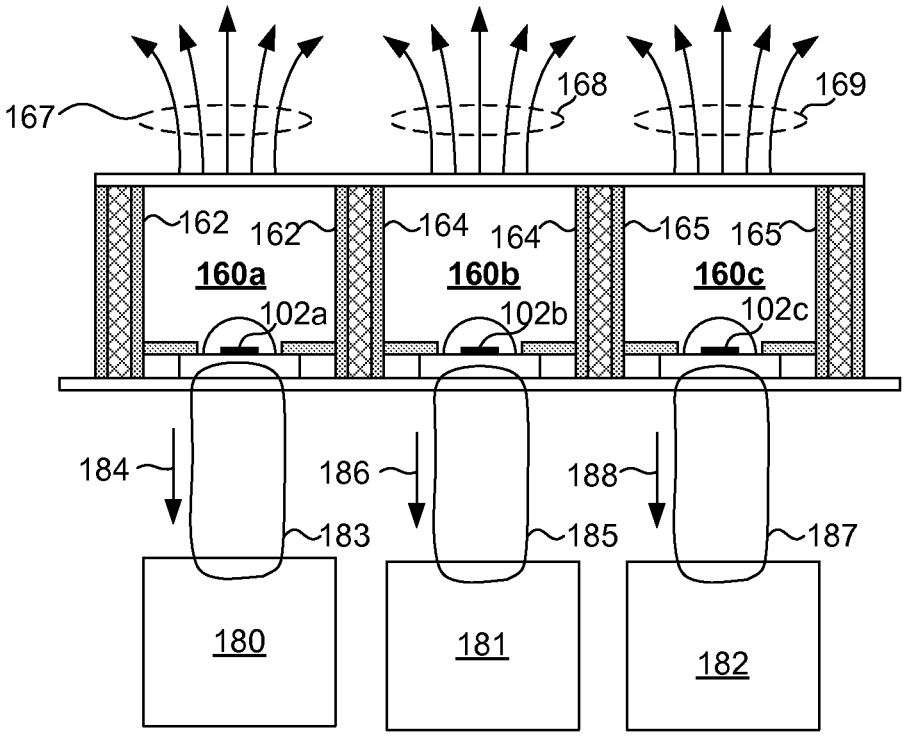

FIG. 13 depicts another embodiment operable to tune the color of light emitted from an LED based illumination module 100 that includes a number of color conversion cavities. By independently controlling the current supplied to different LEDs 102, the flux emitted from each independently controlled color conversion cavity can be determined. In this manner, the output flux of color conversion cavities with different color converting characteristics can be tuned such that the color of light emitted from LED based illumination module 100 matches a target color point. For example, power supply 180 supplies a current 184 to LED 102*a* over conductor 183. Light emitted from LED 102*a* enters color conversion cavity 160*a*, undergoes color conversion, and is emitted as color converted light 167. Similarly, power supply 181 supplies a current 186 to LED 102*b* over conductor 185. Light emitted from LED 102*b* enters color conversion cavity 160*b*, undergoes color conversion, and is emitted as color converted light 168. By adjusting currents 184 and 186, the flux of color converted light 167 and the flux of color converted light 168 are tuned such that the combination of color converted light 167 and 168 matches a target color point. Similarly, additional color conversion cavities may be independently controlled to tune the color point of output light of LED based illumination module 100. As depicted in FIG. 13, power supply 182 supplies a current 188 to LED 102*c* over conductor 187. Light emitted from LED 102*c* enters color conversion cavity 160*c*, undergoes color conversion, and is emitted as color converted light 169. In this manner, currents 184, 186, and 188 may be tuned such that the combination of color converted light 167, 168, and 169 matches a target color point.

Figure 14A:
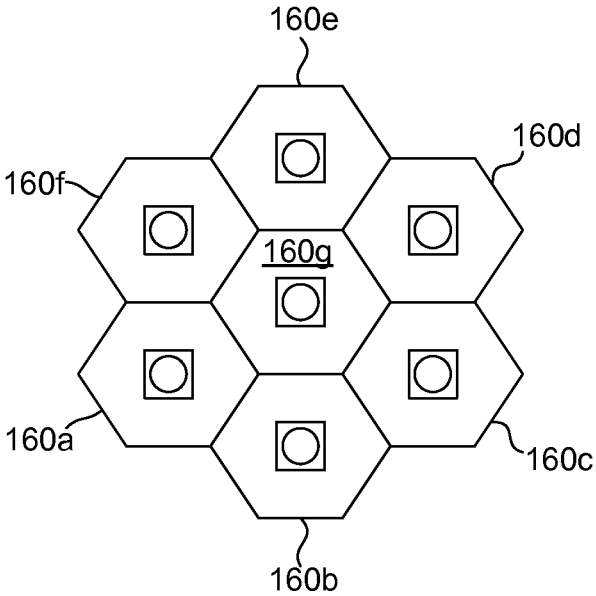
FIGS. 14A-14E depict cross-sectional, top views of various embodiments of an LED based illumination module that includes a number of color conversion cavities.
Figure 14B:
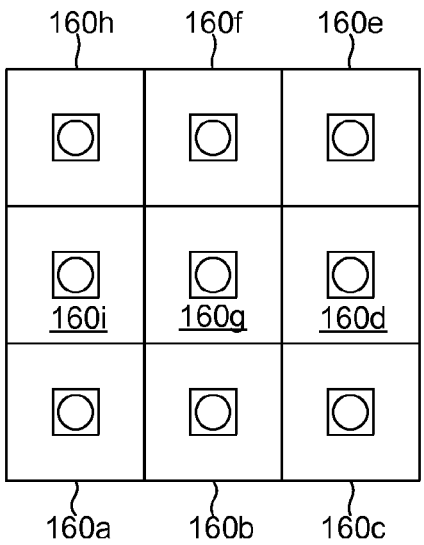
Figure 14C:
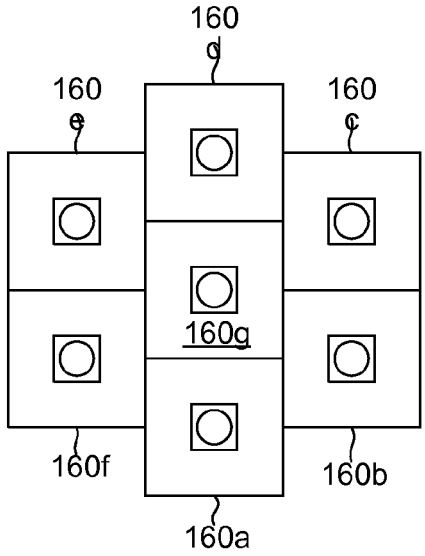
Figure 14D:
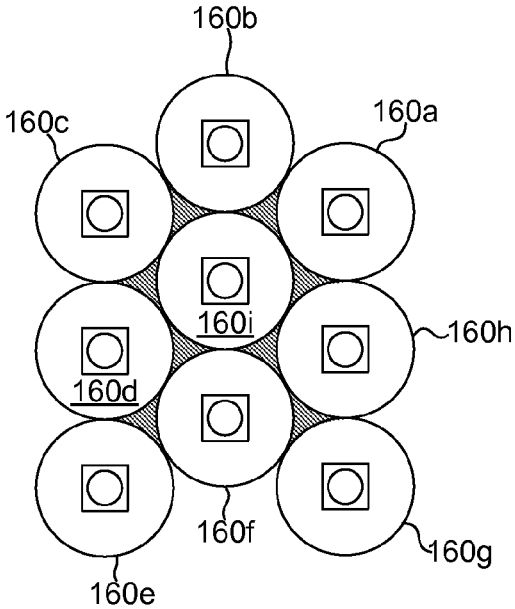
Figure 14E:
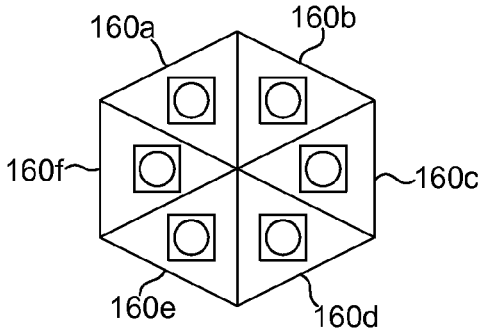

FIGS. 14A-14E depict cross-sectional, top views of various embodiments of LED based illumination module 100. FIG. 14A depicts hexagonally shaped color conversion cavities 160*a*-160*g* arranged in a tightly packed arrangement where sidewalls of each color conversion cavity are shared with another. For example, each sidewall of color conversion cavity 160*g* is shared with another color conversion cavity (160*a*-160*f*), respectively. FIG. 14B depicts rectangular shaped color conversion cavities 160*a*-160*i* arranged in a rectangular grid. In this configuration sidewalls of each color conversion cavity are shared with another. For example, each sidewall of color conversion cavity 160*g* is shared with color conversion cavities 160*a*-160*f* and 160*h*-160*i*, respectively. FIG. 14C depicts rectangular shaped color conversion cavities 160*a*-160*f* arranged in a hexagonal grid. In this configuration a sidewall of each color conversion cavity is shared with multiple color conversion cavities. For example, a sidewall of color conversion cavity 160*g* is shared with color conversion cavity 160*e* and 160*f*. FIG. 14D depicts circular shaped color conversion cavities 160*a*-160*i* arranged in a hexagonal grid. FIG. 14E depicts triangular shaped color conversion cavities 160*a*-160*f* arranged in a tightly packed hexagonal grid. In this configuration sidewalls of each color conversion cavity are shared with another. The embodiments of FIGS. 14A-E are exemplary, but color conversion cavities of different shapes and different layouts may also be considered. For example, color conversion cavities may be shaped as ellipses, star shapes, general polygonal shapes, etc. In addition, grid patterns may be selected that lead to tightly packed configurations. However, in other embodiments, grid patterns that are not tightly packed may be considered.

Figure 15:
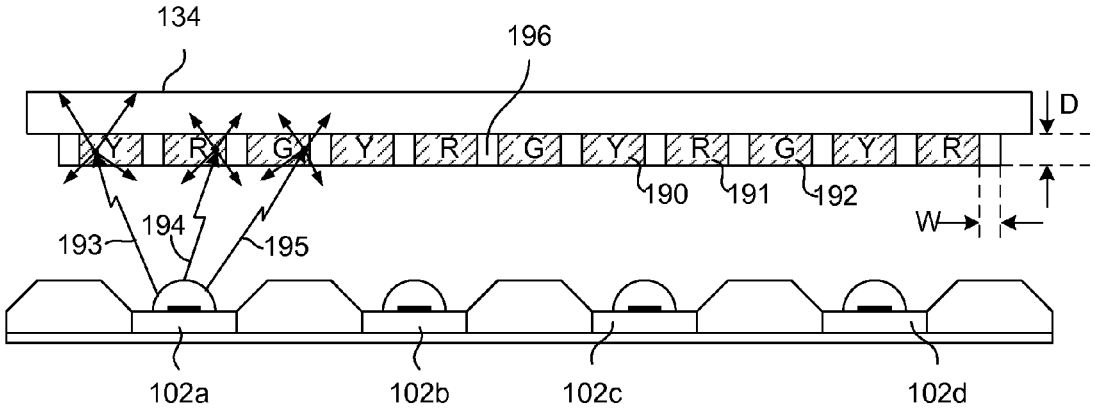
FIGS. 15, 16, and 17 depict cross-sectional side views of various embodiments of an LED based illumination module with a grid structure mounted to a transmissive layer.
Figure 16:
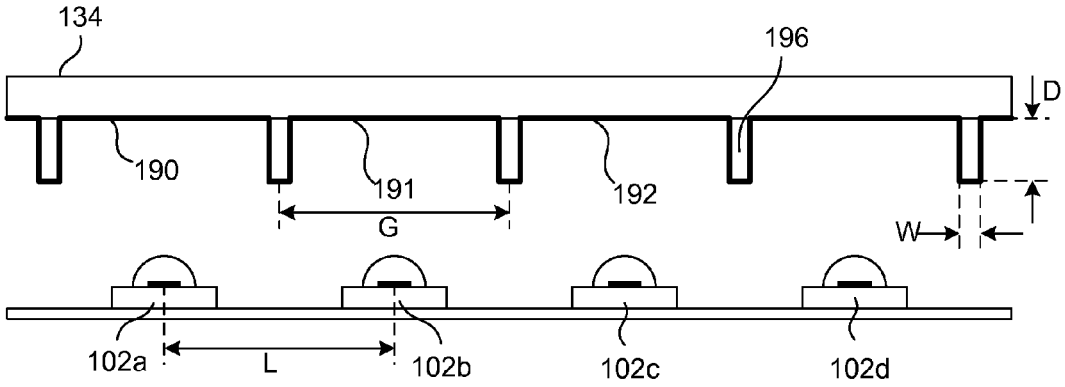
Figure 17:
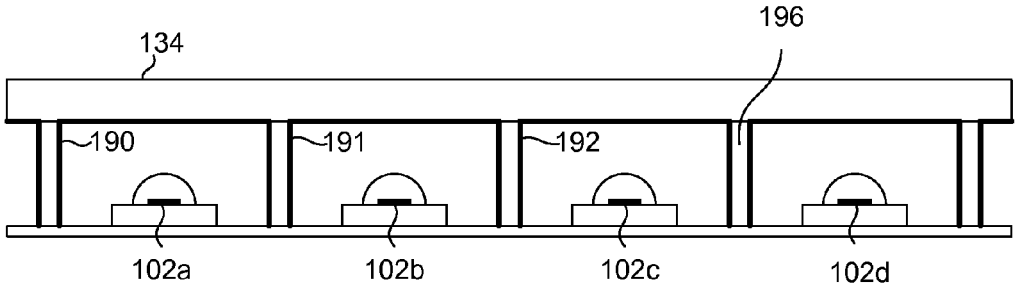

FIGS. 15, 16, 17 depict cross-sectional side views of various embodiments of LED based illumination module 100 with a grid structure 196 mounted to transmissive layer 134. In some embodiments, transmissive layer 134 is the output window 108 of LED based illumination module 100. The grid structure 196 mounted to the transmissive layer 134 forms a number of pockets. Any number of pockets may be coated at least in part by an amount of wavelength converting material. A grid structure mounted to or part of a transmissive layer offers a means of color control with physically separated pockets containing different wavelength converting materials. By altering the number of pockets with different wavelength converting materials, the color of the output light is controlled. In addition, by evenly distributing pockets of different wavelength converting material, output beam uniformity is promoted. Finally, efficiency may be improved by separating different types of wavelength converting material on a plane, so that a significant portion of light emitted from the LEDs is absorbed by a wavelength converting material once and is reemitted as output light. This structure minimizes the probability that the color converted light is reabsorbed by a second type of wavelength converting material.

In the embodiment depicted in FIG. 15, some pockets are filled with a red emitting phosphor 191, other pockets are filled with a green emitting phosphor material 192, and yet other pockets are filled with a yellow emitting phosphor material 190. In this manner some amount of light emitted from each LED is color converted to red, green, and yellow colored light that become part of a combined light 140 emitted by LED based illumination module 100. In some embodiments, grid structure 196 is constructed of PTFE material. Due to its efficient, diffuse reflective properties, PTFE promotes efficient color conversion and allows some transmission of light from LEDs 102 through transmissive layer 134 without color conversion.

In some embodiments, such as those depicted in FIGS. 15 and 16, the pockets are characterized by a depth, D, and a width, W. By tuning the width and depth dimensions of the pockets and the composition of the wavelength converting materials the light emitted from LED based illumination module 100 may be matched to a target color point. FIG. 17 illustrates an embodiment where the depth of the grid structure extends from the transmissive layer 134 to the plane upon which the LEDs 102 are mounted.

Figure 18:
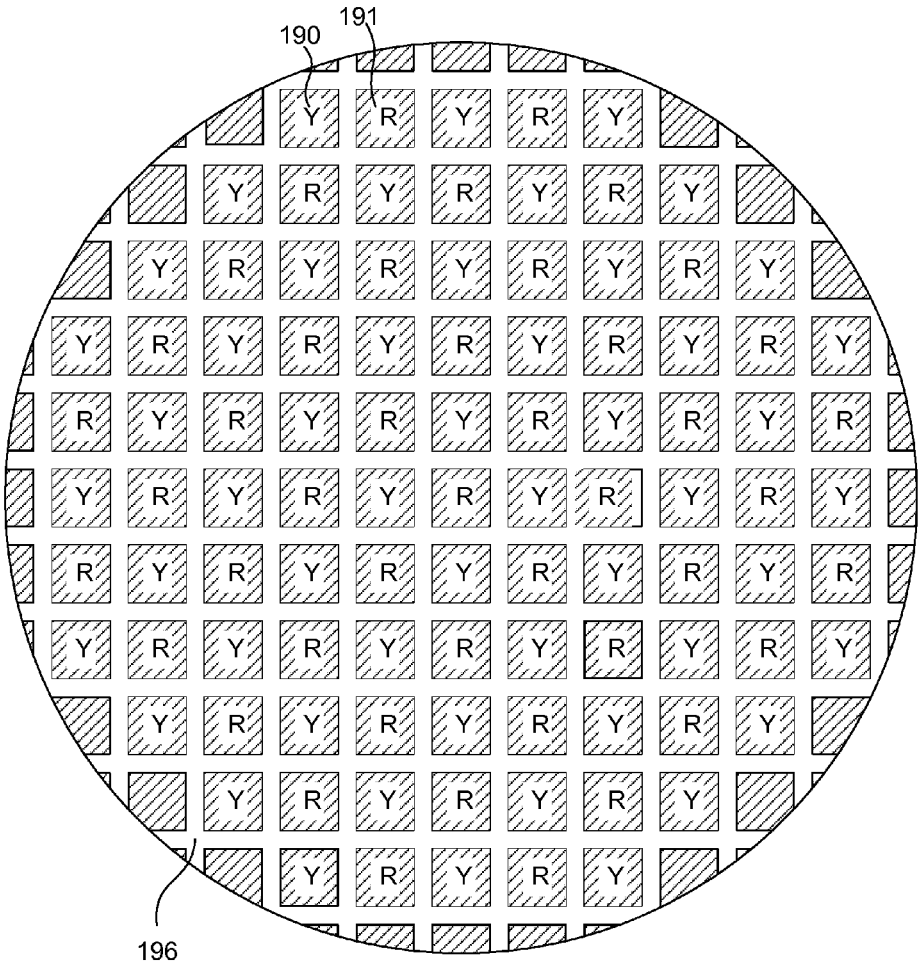
FIG. 18 depicts a cross-sectional top view of a LED based illumination module with a grid structure mounted to a transmissive layer.

FIG. 18 depicts a cross-sectional top view of a LED based illumination module 100 in one embodiment. As depicted, each pocket is coated with either a red emitting phosphor 191 or a yellow emitting phosphor 190. In this embodiment, pockets with red emitting phosphor 191 are evenly distributed with pockets of yellow emitting phosphor 190. In other embodiments, a greater number of pockets may be coated with one phosphor or the other to match a target color point. In some other embodiments, additional phosphors may be included in some pockets.

In some other embodiments, different wavelength converting materials each including a combination of phosphors may coat different pockets to match a target color point. For example, some pockets may be coated with a wavelength converting material that emits white light with a CCT of 3,000 Kelvin and other pockets may be coated with a phosphor that emits white light with a CCT of 4,000 Kelvin. In this manner, by varying the relative number of pockets generating 3,000 Kelvin light and 4,000 Kelvin light, a combined light 140 output by LED based illumination module 100 may be tuned to have a CCT between 3,000 Kelvin and 4,000 Kelvin. As depicted in FIG. 18, each pocket is uniformly square shaped. However, in other embodiments, each pocket may be arbitrarily shaped (e.g., general polygon shapes and general elliptical shapes). Shaping pockets may be desirable to enhance output beam uniformity and color control of light emitted from LED based illumination module 100.

Figure 19:
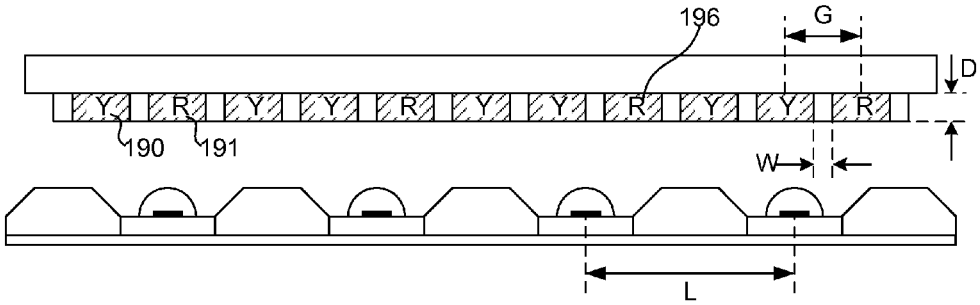
FIG. 19 depict a cross-sectional side view of another embodiment of an LED based illumination module with a grid structure mounted to a transmissive layer.

As depicted in FIG. 19 (and FIG. 16), a pattern of pockets may be characterized by a grid spacing distance, G, and a pattern of LEDs may be characterized by an LED spacing distance, L. In some embodiments, the grid spacing distance may be less than the LED spacing distance (see FIG. 19). In some other embodiments, the grid spacing distance may be the same as the LED spacing distance (see FIG. 16). In some other embodiments, the grid spacing distance may be larger than the LED spacing distance (not shown). Also, as depicted in FIG. 19, the grid spacing distance is larger than the pocket width, W, to ensure that sufficient light emitted from LEDs 102 is color converted by a wavelength converting material. In some embodiments, the grid spacing distance is at least twice the pocket width, W.

Figure 20:
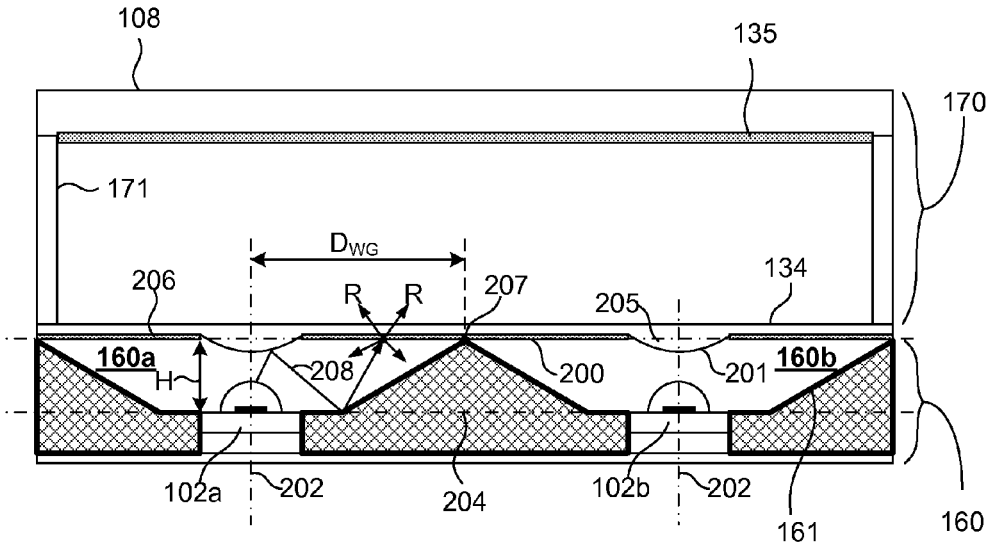
FIG. 20 illustrates a cross-sectional view of an LED based illumination module that includes color conversion cavities configured to disperse and color convert light emitted from an LED over a broad area.

FIG. 20 illustrates a cross-sectional view of another aspect of the LED based illumination module 100 that includes color conversion cavities 160 configured to disperse and color convert light emitted from an LED 102 over a broad area. In this manner, color conversion can be achieved and output beam uniformity promoted in a thin profile structure. As depicted in FIG. 20, a color conversion cavity 160*a* includes at least one reflective sidewall 161 that directs light emitted from LED 102*a* toward transmissive layer 134 disposed above LED 102*a*. The reflective sidewall 161 is oriented at an oblique angle with respect to a plane 204 in which LEDs 102 are disposed. As depicted in FIG. 20, reflective sidewall 161 extends outward and upward to a point of attachment 207 of transmissive layer 134 with reflective sidewall 161. Transmissive layer 134 includes a convex reflector 205 disposed above each LED 102. As depicted, a central axis of reflector 205 is collinear with a central axis 202 of each LED 102 such that each reflector 205 is centered over each LED 102. As depicted, a portion of transmissive layer 134 is coated with a wavelength converting material 206. In this manner, light emitted from LED 102*a* is dispersed laterally and color converted before emission from color conversion cavity 160*a*. For example, a photon 208 (e.g., blue photon) is emitted from LED 102*a*, reflects off reflector 205, subsequently reflects off reflective sidewall 161, and excites wavelength converting material 206. The wavelength converting material 206 absorbs photon 208 and emits color converted light (e.g., red light) that passes through transmissive layer 134 and exits color conversion cavity 160*a*.

As depicted in FIG. 20, color conversion cavity 160*a* extends laterally a distance, $D_{WG}$, from the central axis 202 of LED 102*a* and the point of attachment 207. To promote dispersion of light over a broad area, distance, H, between transmissive layer 134 and plane 204 is less than half of $D_{WG}$. As depicted, in FIG. 20, color conversion cavities 160 are configured to disperse and color convert light emitted from an LED 102 over a broad area by transmitting light laterally and away from LED 102*a* by a series of reflections within a color conversion cavity and then color converting the light emitted from an LED by interaction of that light with a wavelength converting material disposed on a horizontal surface. To further promote the lateral dispersion of light, a reflector is introduced over the LED to reflect light laterally before color conversion.

Figure 21:
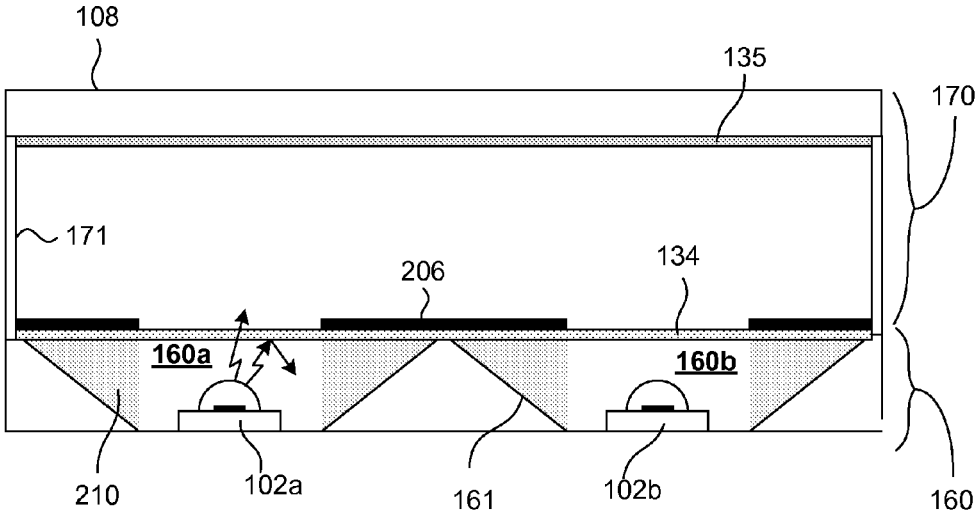
FIG. 21 illustrates a cross-sectional view of an LED based illumination module with color conversion cavities.

FIG. 21 depicts color conversion cavities 160 in another embodiment. In this embodiment transmissive layer 134 is a semi-transparent layer. For example, transmissive layer 134 may be constructed from a thin layer of sintered PTFE. As depicted, transmissive layer 134 does not include a reflector as illustrated in the embodiment of FIG. 20. In lieu of a reflector, the semi-transparent layer permits transmission of part of the light emitted from each LED 102 and reflection another part to promote the lateral dispersion of light within each color conversion cavity.

In another embodiment, each color conversion cavity 160 includes a transparent medium 210 with an index of refraction significantly higher than air (e.g., silicone). In some embodiments, transparent medium 210 fills the color conversion cavity. In some examples the index of refraction of transparent medium 210 is matched to the index of refraction of any encapsulating material that is part of the packaged LED 102. In the illustrated embodiment, transparent medium 210 fills a portion of each color conversion cavity, but is physically separated from the LED 102. This may be desirable to promote extraction of light from the color conversion cavity. As depicted, wavelength converting layer 206 is disposed on transmissive layer 134. In some embodiments, wavelength converting layer 206 includes multiple portions each with different wavelength converting materials. Although depicted as being disposed on top of transmissive layer 134 such that transmissive layer 134 lies between wavelength converting layer 206 and each LED 102, in some embodiments, wavelength converting layer 206 may be disposed on transmissive layer 134 between transmissive layer 134 and each LED 102. In addition, or alternatively, a wavelength converting material may be embedded in transparent medium 210.

Figure 22:
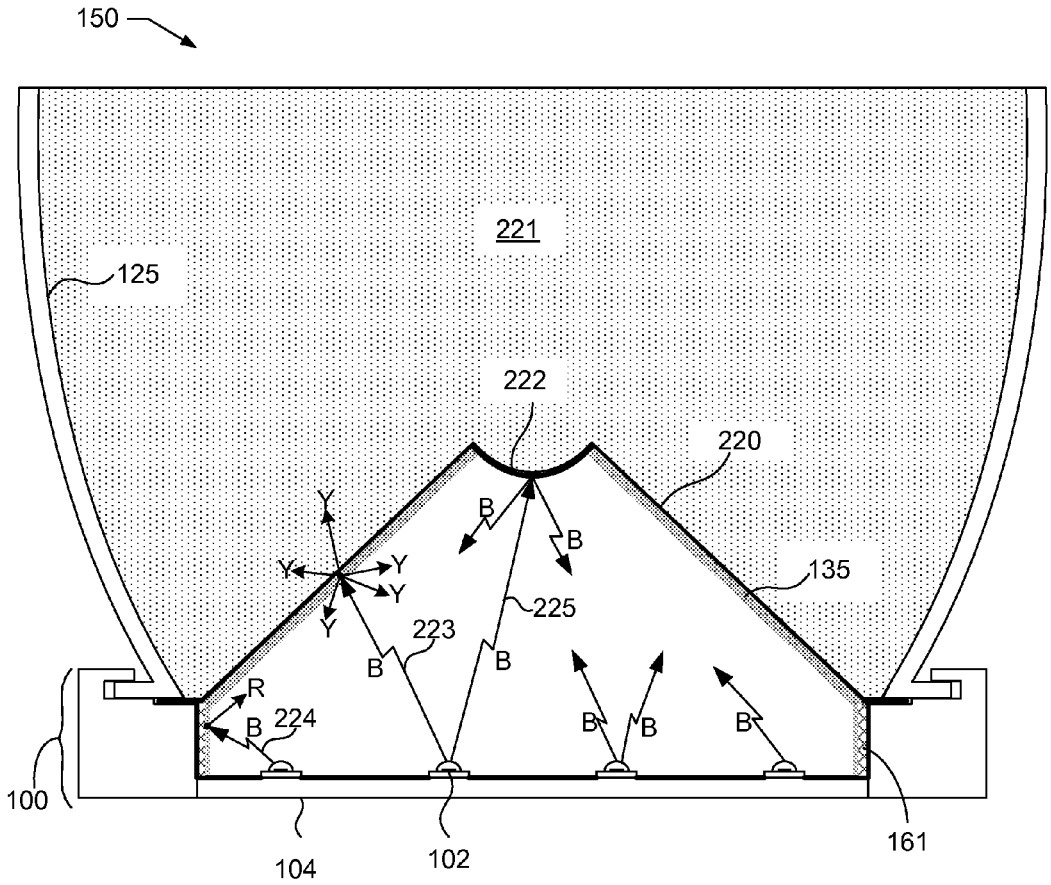
FIGS. 22, 23, and 24 illustrate cross-sectional side views of an LED based illumination module that includes a translucent, non-planar non-planar shaped window disposed above and spaced apart from LEDs.

In another aspect, LED based illumination module 100 includes a translucent, non-planar non-planar shaped window 220 disposed above and spaced apart from LEDs 102 as depicted in FIG. 22. In some embodiments, translucent, non-planar shaped window 220 may be constructed from a molded plastic or glass material. In other embodiments, translucent, non-planar shaped window 220 may be constructed from or include a thin layer of sintered PTFE material. A shaped window that is physically separated from the LEDs promotes light mixing and color uniformity while performing color conversion. The shaped window is enveloped by a reflector. The reflector provides further light mixing to promote uniformity and output beam shaping. The shaped window is designed in conjunction with the reflector to provide color control and output beam uniformity, particularly for narrow output beam designs.

The translucent, non-planar shaped window 220 includes a wavelength converting material that color converts an amount of light emitted from the LEDs 102. For example, as depicted in FIG. 22, blue light 223 emitted from an LED 102 is absorbed by a wavelength converting material included in a color converting layer 135 disposed on translucent non-planar shaped window 220. In response, the wavelength converting material emits light at a longer wavelength (e.g., yellow light). In the embodiment depicted in FIG. 22, the color converting layer 135 that includes a wavelength converting material that is disposed on shaped output window 220. In some other embodiments, a wavelength converting material is embedded within the translucent, non-planar shaped window 220.

As depicted in FIG. 22, the LED based illumination module 100 includes a reflective sidewall 161 in contact with the translucent non-planar shaped window 220. In this manner, light emitted from LEDs 102 is directed through the translucent, non-planar shaped window 220 before exiting the LED based illumination module. In some embodiments, reflective sidewall 161 is coated with a wavelength converting material with a different color conversion characteristic than the wavelength converting material disposed on the translucent, non-planar shaped window 220. For example, as depicted in FIG. 22, blue light emitted from an LED 102 is absorbed by a wavelength converting material disposed on reflective sidewall 161. In response, the wavelength converting material emits light at a longer wavelength (e.g., red light).

As depicted in FIG. 22, a reflector 125 is attached to LED based illumination module 100 to form luminaire 150. Reflector 125 has an interior volume 221 that envelops translucent, non-planar shaped window 220. In this manner, light emitted from LEDs 102 must pass through translucent, non-planar shaped window 220 before reaching the reflecting surfaces of reflector 125. By enclosing LEDs 102 with translucent, non-planar shaped window 220, LEDs 102 are protected from environmental contamination. In addition, the color point of light by luminaire 150 is controlled by the function of LED based illumination module 100; independent of reflector 125. Furthermore, by enveloping translucent, non-planar shaped window 220, reflector 125 is able to control the output beam profile delivered by luminaire 150. In some embodiments, interior volume 221 is filled with a transparent material with an index of refraction greater than air (e.g., silicone). In this manner, light extraction from LED based illumination module 100 is enhanced.

In some embodiments, the translucent, non-planar shaped window 220 includes a reflective portion 222. By appropriate location of a reflective portion 222, the output beam uniformity of light emitted by translucent, non-planar shaped window 220 may be improved. As depicted in FIG. 22, translucent, non-planar shaped window 220 includes a reflective layer disposed on a reflective portion 222 of translucent, non-planar shaped window 220. In some other embodiments, translucent, non-planar shaped window 220 may be constructed of or include a layer of diffuse reflective material (e.g., sintered PTFE). In these embodiments, a separate reflective portion 222 may not be required because sufficient light will be reflected and redirected to another portion of the translucent, non-planar shaped window 220. In these embodiments, a portion of translucent, non-planar shaped window 220 does not include a wavelength converting material.

Figure 23:
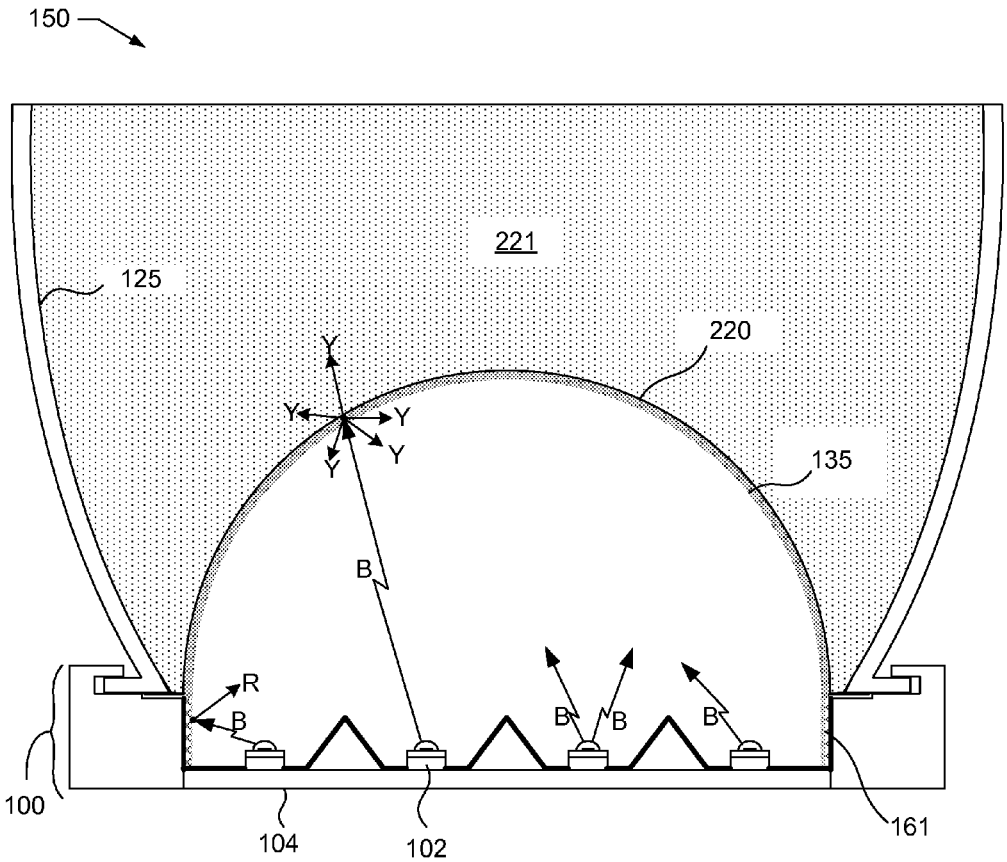

Translucent non-planar shaped window 220 can be shaped to promote output beam uniformity and efficient light extraction from LEDs 102. In the embodiment depicted in FIG. 23, translucent, non-planar shaped window 220 is dome shaped. In some embodiments, the dome shape may be a parabolic shape configured to focus light emitted from LEDs 102 to a specified output beam angle.

Figure 24:
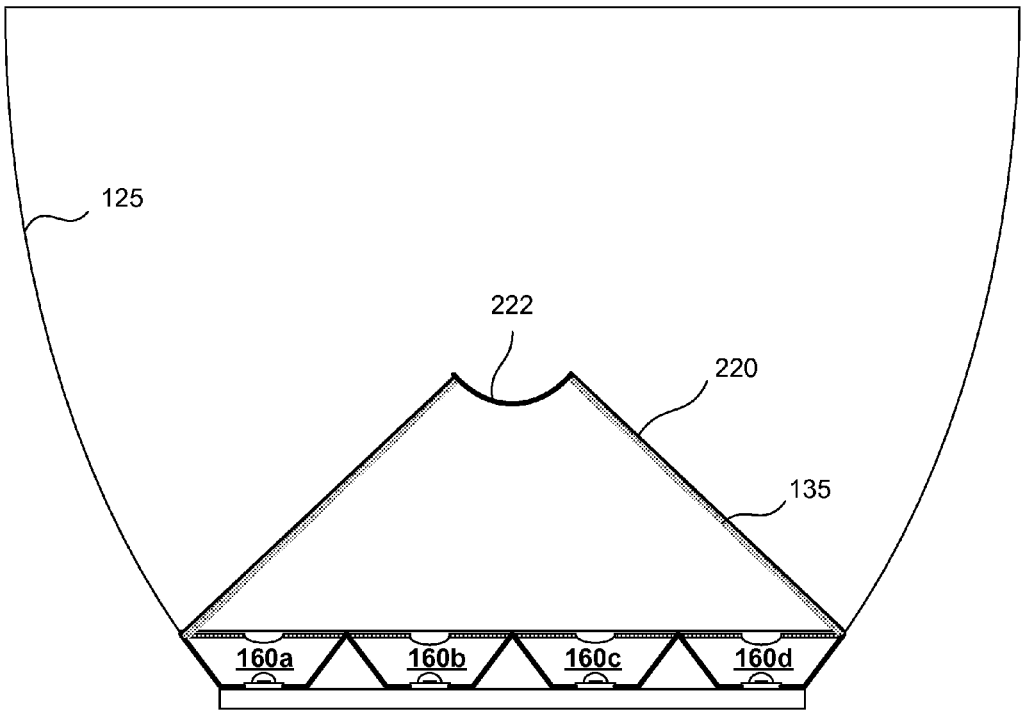

In some embodiments, an LED based illumination module 100 includes a translucent, non-planar shaped window 220 disposed over a plurality of color conversion cavities 160. As depicted in FIG. 24, by way of example, LED based illumination module 100 includes a number of color conversion cavities 160*a*-160*d* configured as described with respect to FIG. 20. Translucent, non-planar shaped window 220 is disposed over the color conversion cavities such that light emitted from each color conversion cavity passes through translucent, non-planar shaped window 220 before interaction with reflector 125.

In some embodiments, components of color conversion cavity 160 may be constructed from or include a PTFE material. In some examples the component may include a PTFE layer backed by a reflective layer such as a polished metallic layer. The PTFE material may be formed from sintered PTFE particles. In some embodiments, portions of any of the interior facing surfaces of color converting cavity 160 may be constructed from a PTFE material. In some embodiments, the PTFE material may be coated with a wavelength converting material. In other embodiments, a wavelength converting material may be mixed with the PTFE material.

In other embodiments, components of color conversion cavity 160 may be constructed from or include a reflective, ceramic material, such as ceramic material produced by CerFlex International (The Netherlands). In some embodiments, portions of any of the interior facing surfaces of color converting cavity 160 may be constructed from a ceramic material. In some embodiments, the ceramic material may be coated with a wavelength converting material.

In other embodiments, components of color conversion cavity 160 may be constructed from or include a reflective, metallic material, such as aluminum or Miro® produced by Alanod (Germany). In some embodiments, portions of any of the interior facing surfaces of color converting cavity 160 may be constructed from a reflective, metallic material. In some embodiments, the reflective, metallic material may be coated with a wavelength converting material.

In other embodiments, (components of color conversion cavity 160 may be constructed from or include a reflective, plastic material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In some embodiments, portions of any of the interior facing surfaces of color converting cavity 160 may be constructed from a reflective, plastic material. In some embodiments, the reflective, plastic material may be coated with a wavelength converting material.

Cavity 160 may be filled with a non-solid material, such as air or an inert gas, so that the LEDs 102 emit light into the non-solid material. By way of example, the cavity may be hermetically sealed and Argon gas used to fill the cavity. Alternatively, Nitrogen may be used. In other embodiments, cavity 160 may be filled with a solid encapsulate material. By way of example, silicone may be used to fill the cavity.

The PTFE material is less reflective than other materials, such as Miro® produced by Alanod, that may be used to construct or include in components of color conversion cavity 160. In one example, the blue light output of an LED based illumination module 100 constructed with uncoated Miro® sidewall insert 107 was compared to the same module constructed with an uncoated PTFE sidewall insert 107 constructed from sintered PTFE material manufactured by Berghof (Germany). Blue light output from illumination module 100 was decreased 7% by use of a PTFE sidewall insert. Similarly, blue light output from illumination module 100 was decreased 5% compared to uncoated Miro® sidewall insert 107 by use of an uncoated PTFE sidewall insert 107 constructed from sintered PTFE material manufactured by W.L. Gore (USA). Light extraction from the illumination module 100 is directly related to the reflectivity inside the cavity 160, and thus, the inferior reflectivity of the PTFE material, compared to other available reflective materials, would lead away from using the PTFE material in the cavity 160. Nevertheless, the inventors have determined that when the PTFE material is coated with phosphor, the PTFE material unexpectedly produces an increase in luminuous output compared to other more reflective materials, such as Miro®, with a similar phosphor coating. In another example, the white light output of an illumination module 100 targeting a correlated color temperature (CCT) of 4,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from illumination module 100 was increased 7% by use of a phosphor coated PTFE sidewall insert compared to phosphor coated Miro®. Similarly, white light output from illumination module 100 was increased 14% compared to phosphor coated Miro® sidewall insert 107 by use of a PTFE sidewall insert 107 constructed from sintered PTFE material manufactured by W.L. Gore (USA). In another example, the white light output of an illumination module 100 targeting a correlated color temperature (CCT) of 3,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from illumination module 100 was increased 10% by use of a phosphor coated PTFE sidewall insert compared to phosphor coated Miro®. Similarly, white light output from illumination module 100 was increased 12% compared to phosphor coated Miro® sidewall insert 107 by use of a PTFE sidewall insert 107 constructed from sintered PTFE material manufactured by W.L. Gore (USA).

Thus, it has been discovered that, despite being less reflective, it is desirable to construct phosphor covered portions of the light mixing cavity 160 from a PTFE material. Moreover, the inventors have also discovered that phosphor coated PTFE material has greater durability when exposed to the heat from LEDs, e.g., in a light mixing cavity 160, compared to other more reflective materials, such as Miro®, with a similar phosphor coating.

Although certain specific embodiments are described above for instructional purposes, the teachings of this patent document have general applicability and are not limited to the specific embodiments described above. For example, any component of color conversion cavity 160 may be patterned with phosphor. Both the pattern itself and the phosphor composition may vary. In one embodiment, the illumination device may include different types of phosphors that are located at different areas of a light mixing cavity 160. For example, a red phosphor may be located on either or both of the insert 107 and the bottom reflector insert 106 and yellow and green phosphors may be located on the top or bottom surfaces of the output window 108 or embedded within the output window 108. In one embodiment, different types of phosphors, e.g., red and green, may be located on different areas on the sidewalls 107. For example, one type of phosphor may be patterned on the sidewall insert 107 at a first area, e.g., in stripes, spots, or other patterns, while another type of phosphor is located on a different second area of the insert 107. If desired, additional phosphors may be used and located in different areas in the cavity 160. Additionally, if desired, only a single type of wavelength converting material may be used and patterned in the cavity 160, e.g., on the sidewalls. In another example, cavity body 105 is used to clamp mounting board 104 directly to mounting base 101 without the use of mounting board retaining ring 103. In other examples mounting base 101 and heat sink 120 may be a single component. In another example, LED based illumination module 100 is depicted in FIGS. 1-3 as a part of a luminaire 150. As illustrated in FIG. 3, LED based illumination module 100 may be a part of a replacement lamp or retrofit lamp. But, in another embodiment, LED based illumination module 100 may be shaped as a replacement lamp or retrofit lamp and be considered as such. Accordingly, various modifications, adaptations, and combinations of various features of the described embodiments can be practiced without departing from the scope of the invention as set forth in the claims.

What is claimed is:

1. An apparatus, comprising:

a plurality of LEDs;

an output window disposed above the plurality of LEDs, wherein an amount of light emitted from the plurality of LEDs passes through the output window;

a grid structure disposed on the output window between the plurality of LEDs and the output window, wherein the grid structure attached to the output window forms a plurality of pockets, each with an interior surface area;

a first wavelength converting material coated on at least a portion of the interior surface area of a first number of the plurality of pockets; and a second wavelength converting material coated on at least a portion of the interior surface area of a second number of the plurality of pockets.

2. The apparatus of claim 1, wherein the first wavelength converting material fills the first number of the plurality of pockets and the second wavelength converting material fills the second number of the plurality of pockets.

3. The apparatus of claim 1, wherein the plurality of pockets are uniformly sized and spaced apart by a first distance, and wherein the plurality of LEDs are spaced apart from each other by at least a second distance, and wherein the first distance is less than the second distance.

4. The apparatus of claim 1, wherein the plurality of pockets are uniformly sized and spaced apart by a first distance, and wherein the plurality of LEDs are spaced apart from each other by a second distance, and wherein the first distance is the same as the second distance such that each pocket corresponds to a single LED of the plurality of LEDs.

5. The apparatus of claim 1, wherein the output window is constructed from sintered polytetrafluoroethylene (PTFE).

6. The apparatus of claim 1, wherein the grid structure is constructed from sintered polytetrafluoroethylene (PTFE).

7. The apparatus of claim 1, wherein each of the plurality of LEDs are mounted in a plane, and wherein the grid structure extends from the output window to the plane.

8. The apparatus of claim 1, wherein a secondary mixing cavity is disposed above the output window.

9. The apparatus of claim 1, wherein:

a light emitting diode (LED) of the plurality of LEDs is disposed in a first plane, the LED having a central axis extending perpendicular to a die area of the LED;

a reflective sidewall that surrounds the LED, wherein the reflective sidewall is oriented at an oblique angle with respect to the first plane and extends from the first plane to a second plane that lies a first distance above the first plane; and the output window is disposed in the second plane and attached to the reflective sidewall.

10. The apparatus of claim 9, wherein the first distance is less than half a distance measured in the second plane from a point of attachment of the output window to the reflective sidewall and the central axis of the LED.

11. The apparatus of claim 9, further comprising:

a convex spherical reflector attached to the output window and disposed above the LED between the output window and the LED.

12. The apparatus of claim 9, further comprising:

a second window disposed above the output window, wherein a portion of the second window is coated with a third wavelength converting material.

13. The apparatus of claim 12, wherein the window is spaced apart from the output window.

14. The apparatus of claim 9, wherein the reflective sidewall is diffuse reflective and at least a portion of the reflective sidewall is coated with the first wavelength converting material.

15. The apparatus of claim 9, wherein a space between the LED and the reflective sidewall is filled with a solid, transparent medium.

16. The apparatus of claim 15, wherein the first wavelength converting material is embedded in the solid, transparent medium.

17. An LED based illumination device, comprising:

a transmissive layer mounted above a first color conversion cavity, the transmissive layer includes a grid structure disposed on the transmissive layer, wherein the grid structure forms a plurality of pockets, each with an interior surface area, wherein a first wavelength converting material is coated on at least a portion of the interior surface area of a first number of the plurality of pockets.

18. The LED based illumination device of claim 17, further comprising:

a sidewall with a first surface area comprising the portion of the interior surface area of the first color conversion cavity, wherein the first surface area is coated with a second wavelength converting material; and a first LED, wherein light emitted from the first LED directly enters the first color conversion cavity.

19. The LED based illumination device of claim 18, further comprising:

a second LED, wherein light emitted from the second LED directly enters a second color conversion cavity and does not directly enter the first color conversion cavity, wherein the transmissive layer is mounted above the second color conversion cavity, wherein a second wavelength converting material is coated on at least a portion of the interior surface area of a second number of the plurality of pockets disposed over the second color conversion cavity.

20. The LED based illumination device of claim 17, wherein a second wavelength converting material is coated on at least a portion of the interior surface area of a second number of the plurality of pockets.

* * * * *